US010659865B2

(12) United States Patent
Royer

(10) Patent No.: US 10,659,865 B2
(45) Date of Patent: May 19, 2020

(54) HEADSET AND METHOD FOR AUTOMATIC REDUCTION OF EAR PRESSURE AND BAROTRAUMA

(71) Applicant: Brianna Marie Royer, Frisco, TX (US)

(72) Inventor: Brianna Marie Royer, Frisco, TX (US)

( * ) Notice: Subject to any disclaimer, the term of this patent is extended or adjusted under 35 U.S.C. 154(b) by 0 days.

(21) Appl. No.: 15/981,552

(22) Filed: May 16, 2018

(65) Prior Publication Data

US 2018/0338198 A1 Nov. 22, 2018

Related U.S. Application Data

(60) Provisional application No. 62/506,827, filed on May 16, 2017.

(51) Int. Cl.
*H04R 1/10* (2006.01)

(52) U.S. Cl.
CPC ..... *H04R 1/1041* (2013.01); *H04R 1/1008* (2013.01); *H04R 2420/09* (2013.01)

(58) Field of Classification Search
CPC ..... H04R 1/1041; H04R 1/1008; H04R 2420/09; A61B 5/12
USPC ..... 381/74
See application file for complete search history.

(56) References Cited

U.S. PATENT DOCUMENTS 4,688,582 A 8/1987 Heller et al.
5,819,745 A 10/1998 Mobley et al.
8,199,955 B2 6/2012 Akino
8,625,833 B1 1/2014 Armwood
2010/0296682 A1* 11/2010 Palmer ..... A61F 11/06 381/332
2012/0057734 A1 3/2012 Ambrose et al.
2015/0092971 A1 4/2015 Kim
2015/0264472 A1 9/2015 Aase

FOREIGN PATENT DOCUMENTS

CN 103079137 1/2013
CN 203027439 1/2013

OTHER PUBLICATIONS

Arduino Tutorial "Digital Pins." Available at: https://www.arduino.cc/en/Tutorial/DigitalPins; Accessed on Jul. 20, 2018.

(Continued)

*Primary Examiner* — Vivian C Chin
*Assistant Examiner* — Douglas J Suthers

(57) ABSTRACT

A headset and method for controlling pressure in the ears of a user is disclosed. The headset includes a headband, a control earpiece connected to the headband, an earpiece connected to the headband, and a control system housed in the control earpiece and the earpiece to manually and/or automatically control the pressure in each of the control earpiece and the earpiece. In one embodiment, the pressure in each of the control earpiece and the earpiece is manually controlled by increasing and/or decreasing the pressure in each of the control earpiece and the earpiece. In another embodiment, the pressure in each of the control earpiece and the earpiece is automatically adjusted in a ground pressure mode, an ascent mode, and/or a descent mode.

5 Claims, 29 Drawing Sheets

(56) References Cited

OTHER PUBLICATIONS

Mjlorton, Arduino Tutorial #1—Getting Started and Connected!, YouTube, Jul. 9, 2012. Available at: https://www.youtube.com/watch?v=kLd_JyvKV4Y; Accessed on Jan. 27, 2017.
Harvard Health Online, Barotrauma, Harvard Medical School, Oct. 2012, Harvard Health Publishing. Available at: https://www.health.harvard.edu/diseases-and-conditions/barotrauma.
Brandon G. Bentz, M.D. and C. Anthony Hughes, M.D., Barotrauma, American Hearing Research Foundation, Oct. 2012. Available at: https://www.american-hearing.org/disorders/barotrauma/.
Cedars-Sinai, Ear Barotrauma. Available at: https://www.cedars-sinai.org/health-library/diseases-and-conditions/e/ear-barotrauma.html; Accessed on Jul. 20, 2018.
Gadget Junkie, Equalizers—Pressure Equalizing Earbuds. Available at: http://www.gadgetify.com/equalizers-pressure-equalizing-earbuds/; Accessed on Jul. 20, 2018.
Formlabs, Guide to Painting 3D Printed Parts: Priming, Formlabs. Available at: https://formlabs.com/blog/priming-3d-printed-parts/; Accessed on Jan. 27, 2017.
Discovery/Science Channel, "How It's Made" Headphones, YouTube, Dec. 29, 2009. Available at: https://www.youtube.com/watch?v=3LbsQRaQD6A.
Curiousinventor, How to Solder Electronics, YouTube, May 25, 2015. Available at: https://www.youtube.com/watch?v=lpkkfK937mU; Accessed on Jan. 27, 2017.
Mayo Clinic, Airplane Ear. Available at: https://www.mayoclinic.org/diseases-conditions/airplane-ear/symptoms-causes/syc-20351701; Accessed on Jul. 20, 2018.
Dave Evans, Ultimate Guide to Finishing 3D Printed Parts, Fictiv—Hardware Guide, Fictiv Inc., Jan. 28, 2015. Available at: https://hwg.fictiv.com/fabricate/ultimate-guide-to-finishing-3d-printed-parts; Accessed on Jan. 27, 2017.
Formlabs, The Ultimate Guide to Painting 3D Printed Parts, Formlabs. Available at: https://formlabs.com/blog/painting-3d-printed-parts; Accessed on Jan. 27, 2017.
TR Industrial Schutz Compact Foldable Ear Muffs with Soft Adjustable Headband, NRR=34dB, CE Approved, ANSI S12.42/S3.19, Yellow, Black, Cookware Canada product page. Available at: http://www.cookwarecanada.ca/tr-industrial-schutz-compact-foldable-ear-muffs-with-soft-adjustable-headband-nrr-34db-ce-approved-ansi-s12-42-s3-19-yellow-black/; Accessed on Jul. 20, 2018.
Stansport Plastic Bellows Foot Pump, Amazon product page. Available at: https://www.amazon.com/Stansport-Plastic-Bellows-Foot-Pump/dp/B000PTKQDM; Accessed on Jul. 20, 2018.
Desxz B570 LCD Display Screen Foldable 3.5MM wired Wireless Stereo Bluetooth Headphone Handsfree with Mic FM Radio TF Card Slot, Amazon product page. Available at: https://www.amazon.com/Desxz-Foldable-Bluetooth-Headphone-Handsfree/dp/B01E02B3TK; Accessed on Jul. 20, 2018.
Bluetooth Headphones With Different Colors Screen, Mercado Libre product page. Available at: https://articulo.mercadolibre.com.co/MCO-455333032-audifonos-bluetooth-con-pantalla-diferentes-colores-_JM; Accessed on Jul. 20, 2018.
Barometric Pressure Tinyshield, TinyCircuits product page. Available at: https://tinycircuits.com/products/barometric-pressure-tinyshield; Accessed on: Jul. 20, 2018.
Board Mount Pressure Sensor, BMP280 by Bosch, Arrow product page. Available at: https://www.arrow.com/en/products/bmp280/bosch?utm_source=google&utm_campaign=g-shp-us-sensors&utm_medium=cpc&utm_term=PRODUCT+GROUP&gclid=EAIaIQobChMI6rHRn66r3AIV27XACh0J6AOAEAQYAyABEgKamfD_BwE&gclsrc=aw.ds&dclid=CLX9vKGuq9wCFQy_wAod2WUKyg; Accessed on: Jul. 20, 2018.
Design House 3½ in. × 3½ in.-⅝ in. Radius Satin Nickel Corner Door Hinge-202481, The Home Depot product page. Available at: https://www.homedepot.com/p/Design-House-3-1-2-in-x-3-1-2-in-5-8-in-Radius-Satin-Nickel-Corner-Door-Hinge-202481/203447341; Accessed on Jul. 20, 2018.
Dismantling Technics RP-DH1200, CustomCans.co.uk Custom Headphone Blog, Feb. 12, 2019. Available at: https://www.customcans.co.uk/blog/?p=126.
Download Parts of a Door Hinge, Fresh Furniture. Available at: http://architects-rock.com/parts-of-a-door-hinge/parts-of-a-door-hinge-projects-ideas-2-the-original-adjustable-door-hinge-sticking-door/; Accessed on Jul. 20, 2018.
Dual Motor Tinyshield, TinyCircuits product page. Available at: https://tinycircuits.com/products/dual-motor-tinyshield; Accessed on Jul. 20, 2018.
Peltor Protectors Junior Pink Earmuff, Patriot Outfitters product page. Available at: http://www.patriotoutfitters.com/Workwear_2/Work-Clothes-Hearing-Protection_2/; Accessed on Jul. 20, 2018.
Stainless Steel Marine Heavy Duty Strap Hinges 4" or 6", Hinge Outlet product page. Available at: https://www.hingeoutlet.com/products/s3820-0100; Accessed on Jul. 20, 2018.
Tiny Battery Charger, TinyCircuits product page. Available at: https://tinycircuits.com/products/tiny-battery-charger; Accessed on Jul. 20, 2018.
TinyDuino Processor Board, TinyCircuits product page. Available at: https://tinycircuits.com/products/tinyduino-processor-board; Accessed on Jul. 20, 2018.
TinyScreen OLED TinyShield, TinyCircuits produt page. Available at: https://tinycircuits.com/products/tinyscreen; Accessed on Jul. 20, 2018.
https://www.adafruit.com/?gclid=EAIaIQobChMlueedm-MOk3AIVTrjACh1JFA1wEAAYASAAEgL7N_D_BwE; Accessed on Jul. 20, 2018.
International Preliminary Report on Patentability for International Application No. PCT/US2018/033012 dated Nov. 28, 2019.

* cited by examiner

HEADSET AND METHOD FOR AUTOMATIC REDUCTION OF EAR PRESSURE AND BAROTRAUMA

CROSS-REFERENCE TO RELATED APPLICATION

This application claims priority to U.S. Provisional Application No. 62/506,827, filed May 16, 2017. This patent application is incorporated herein by reference in its entirety to provide continuity of disclosure.

FIELD OF THE INVENTION

The present invention relates to systems, apparatuses, and methods for ear protection. In particular, the present invention relates to a headset and method for the automatic adjustment of pressure and barotrauma on human ears.

BACKGROUND OF THE INVENTION

Barotrauma is a condition of a human ear wherein a pressure difference is present between the inner ear and outer ear, commonly caused by altitude changes usually in an ascent and a descent during flight. In some cases, the pressure difference can be relieved conventionally by yawning, or chewing gum. However, individuals with congestion and/or blocked Eustachian tubes are incapable of solving this condition through these conventional methods. In some cases, antibiotics or steroids may need to be prescribed to relieve possible inflammation or infection.

Further, in some severe cases ear barotrauma can cause a ruptured eardrum. In such cases, self-healing of the ruptured eardrum can take up to two to three weeks. In most severe cases where self-healing is insufficient, surgery is required to repair the damage. In chronic cases of ear barotrauma, ear tubes may be surgically implanted to relieve the condition and may require further surgeries to reinstall and/or maintain the ear tube implant.

Therefore, there is a need in the art for an exterior solution that slows the pressure change. There is a further need in the art for a device that allows users to fine tune the pressure to suit any desired need. There is another need in the art for a device to relieve the pressure agitation for infants and small children, who typically have smaller Eustachian tubes. A headset and method for relieving ear pressure and reducing barotrauma is disclosed.

SUMMARY

A headset and method for controlling pressure in the ears of a user is disclosed. The headset includes a headband, a control earpiece connected to the headband, an earpiece connected to the headband, and a control system housed in the control earpiece and the earpiece to manually and/or automatically control the pressure in each of the control earpiece and the earpiece. In one embodiment, the pressure in each of the control earpiece and the earpiece is manually controlled by increasing and/or decreasing the pressure in each of the control earpiece and the earpiece. In another embodiment, the pressure in each of the control earpiece and the earpiece is automatically adjusted in a ground pressure mode, an ascent mode, and/or a descent mode.

BRIEF DESCRIPTION OF THE DRAWINGS

In the detailed description presented below, reference will be made to the following drawings.

DETAILED DESCRIPTION

Figure 1:
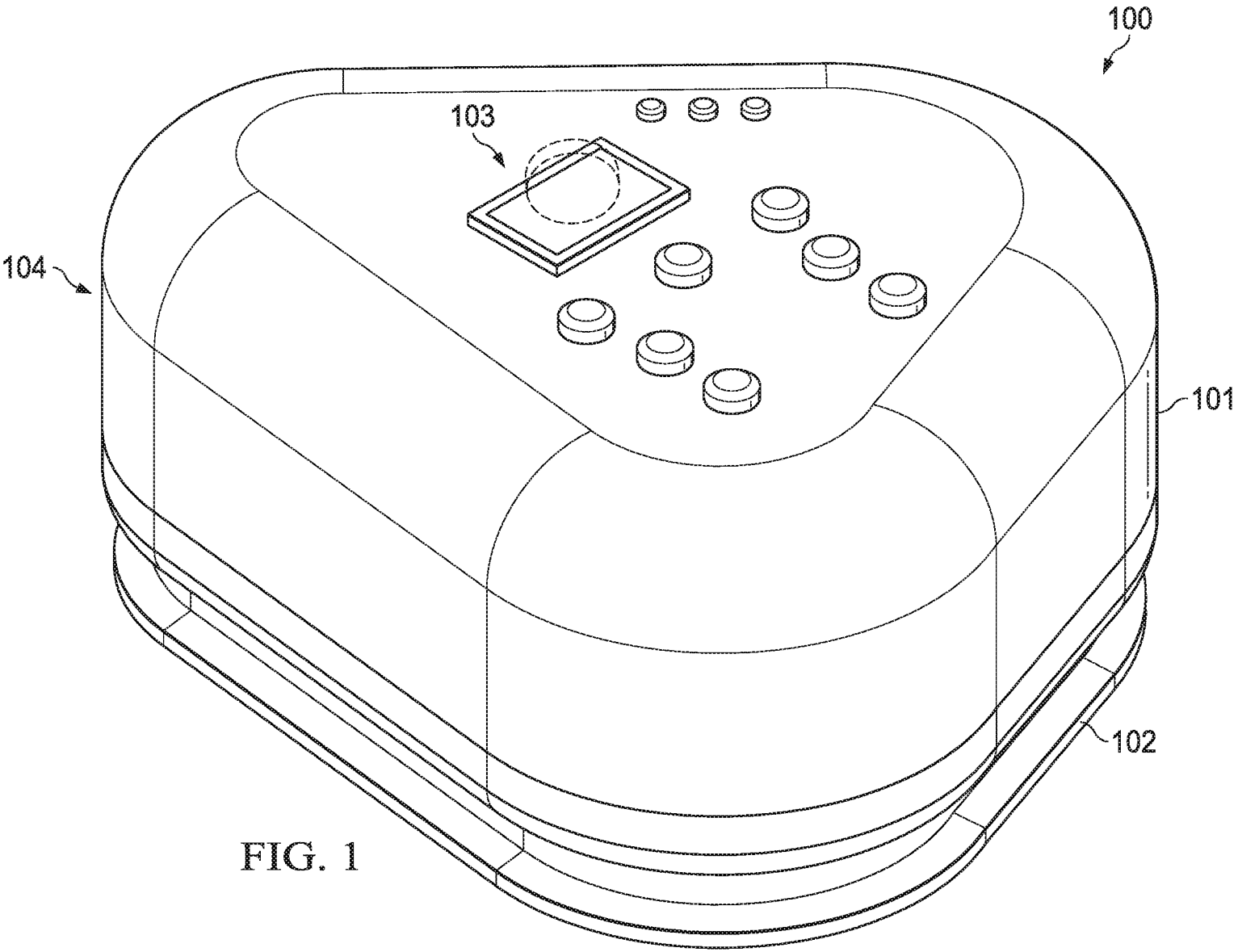
FIG. 1 is an isometric view of a control earpiece of a headset of a preferred embodiment.

Referring to FIG. 1 in one embodiment, control earpiece 100 includes outer shell 101 and inner shell 102 connected to outer shell 101. Outer shell 101 includes connector 104 for connection to a headband. Outer shell 101 includes a set of controls 103 that will be further described below.

In a preferred embodiment, connector 104 is a hinge connection. Other suitable connection means known in the art may be employed.

In a preferred embodiment, control earpiece 100 has a generally triangular shape and is sized to fit over the ear of a user. Other suitable shapes, sizes, and fits known in the art may be employed, including ear bud styles.

In a preferred embodiment, control earpiece 100 is worn on the left ear of the user. In another embodiment, control earpiece 100 is worn on the right ear of the user. In other embodiments, control earpiece 100 is worn on each of the left ear and right ear of the user such that each control earpiece 100 controls the pressure in the ear on which the respective control earpiece 100 is worn.

Figure 2:
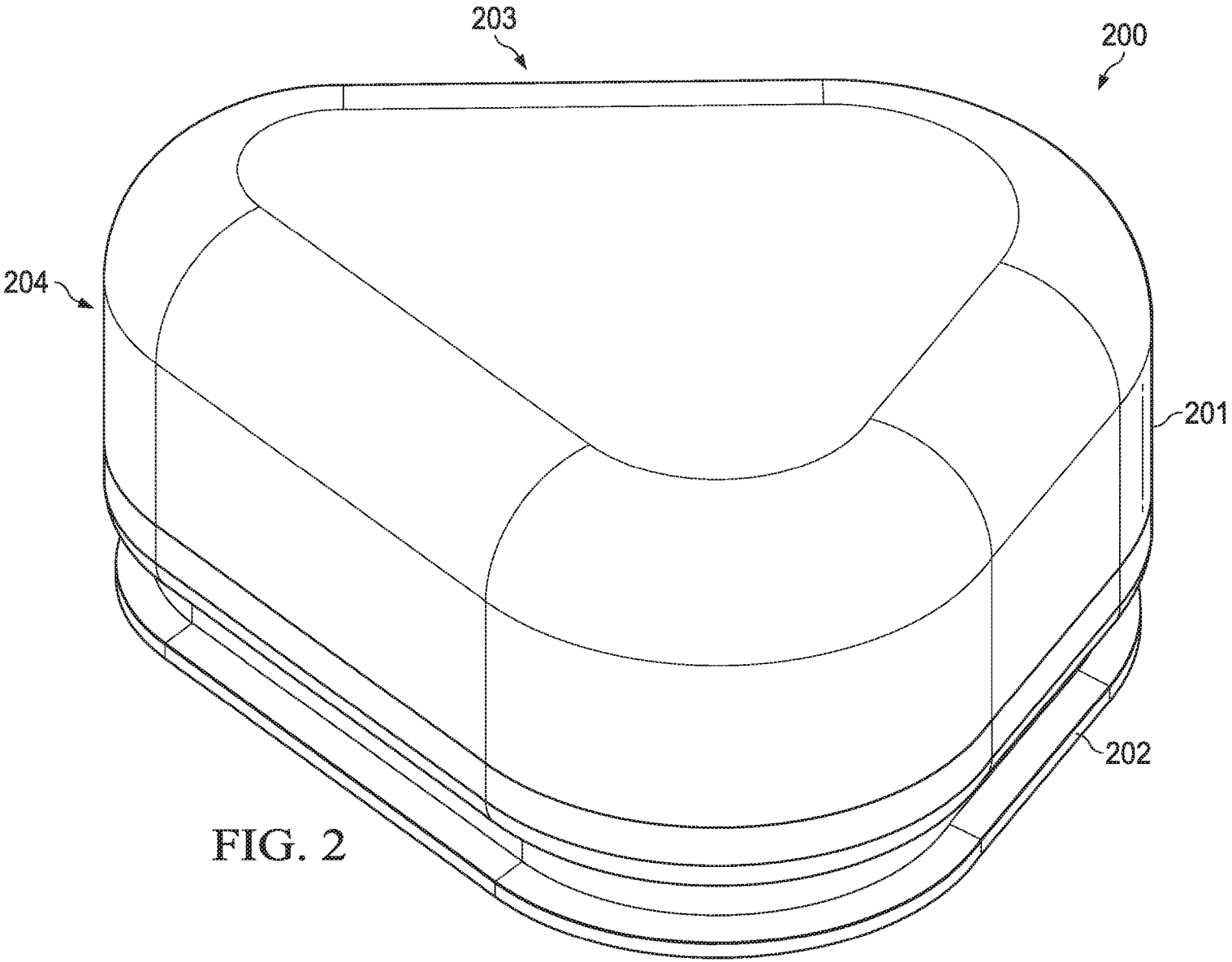
FIG. 2 is an isometric view of an earpiece of a headset of a preferred embodiment.

Referring to FIG. 2, earpiece 200 includes outer shell 201 and inner shell 202 connected to outer shell 201. Outer shell 201 includes display 203 and connector 204 for connection to a headband.

In a preferred embodiment, connector 204 is a hinge connection. Other suitable connection means known in the art may be employed.

In a preferred embodiment, earpiece 200 has a generally triangular shape and is sized to fit over the ear of a user. Other suitable shapes, sizes, and fits known in the art may be employed, including ear bud styles.

In a preferred embodiment, control earpiece 100 is worn on the right ear of the user. In this embodiment, earpiece 200 is worn on the left ear of the user. In another embodiment, control earpiece 100 is worn on the left ear of the user. In this embodiment, earpiece 200 is worn on the right ear of the user. In other embodiments, earpiece 200 is substituted by control earpiece 100, which is worn on each of the left ear and right ear of the user such that each control earpiece 100 controls the pressure in the ear on which the respective control earpiece 100 is worn.

Figure 3:
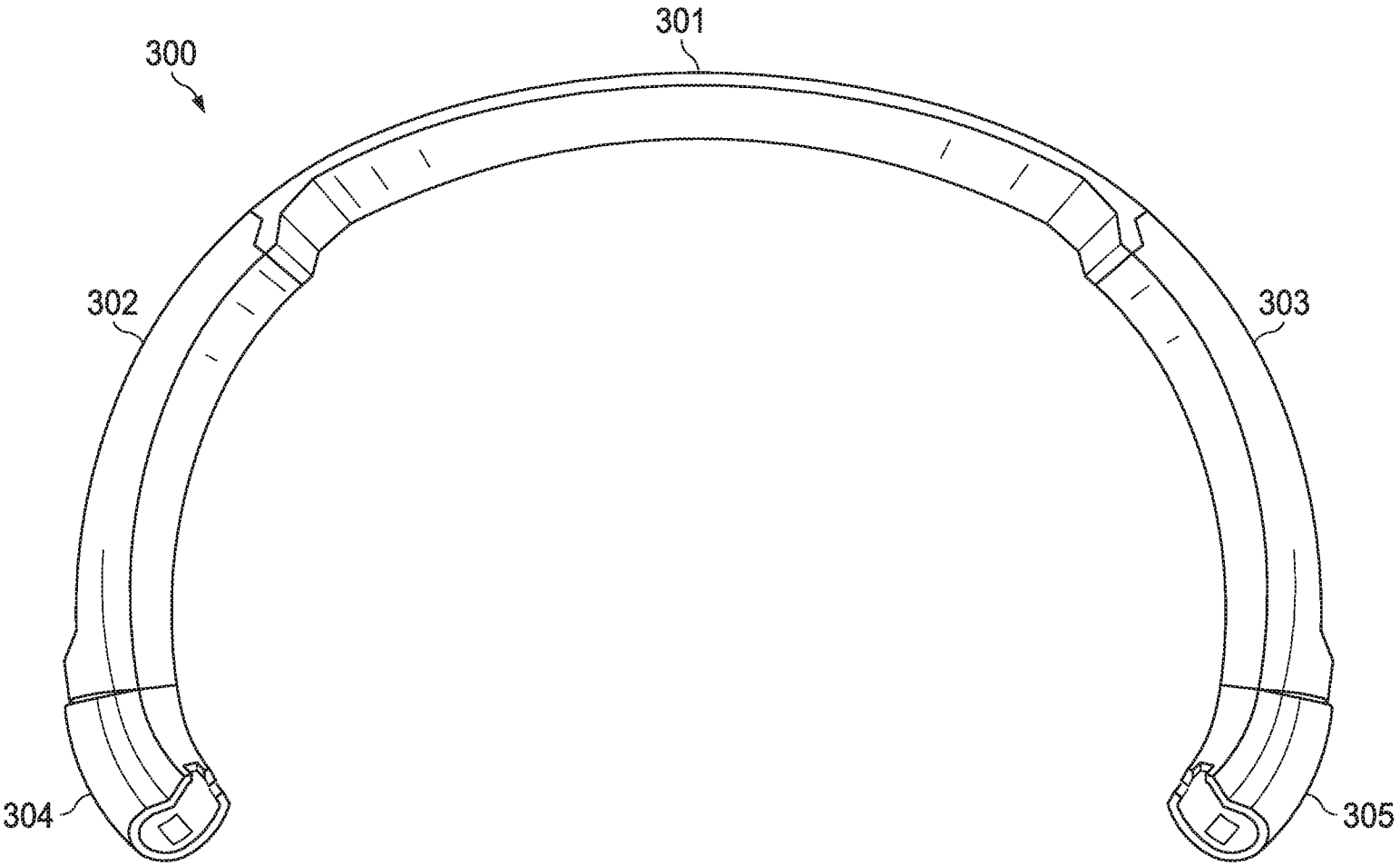
FIG. 3 is an end view of a headband of a headset of a preferred embodiment.

Referring to FIG. 3, headband 300 includes main portion 301, first connector portion 302 adjustably connected to main portion 301, and second connector portion 303 adjustably connected to main portion 301. Connector portion 302 includes connector 304 for connection to control earpiece 100 or earpiece 200. Connector portion 303 includes connector 305 for connection to control earpiece 100 or earpiece 200.

In a preferred embodiment, headband 300 is made of a durable plastic. Other suitable materials known in the art may be employed.

In a preferred embodiment, each of connectors 304 and 305 is a hinge connection. Other suitable connection means known in the art may be employed.

Figure 4A:
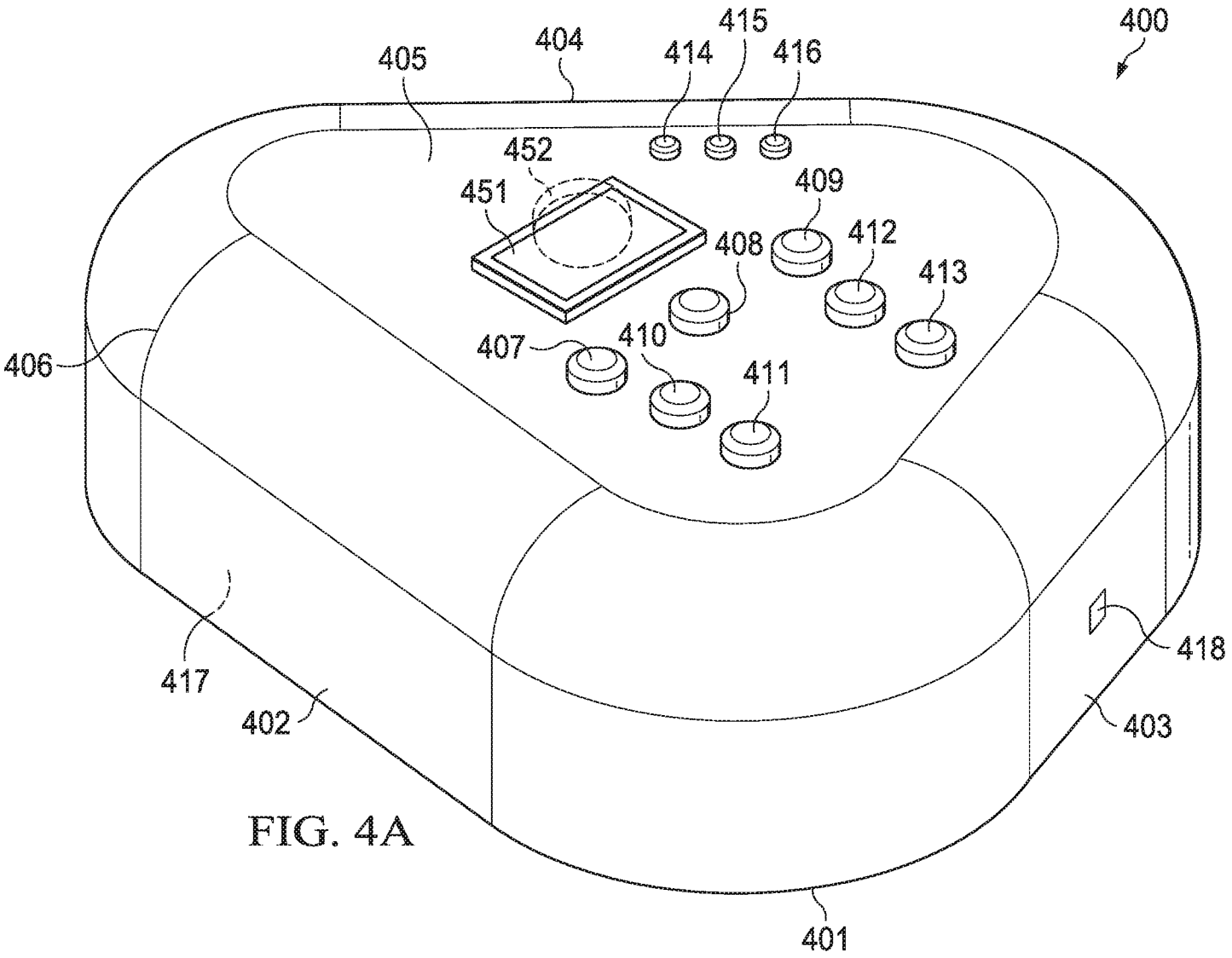
FIG. 4A is an isometric view of an outer shell of a control earpiece of a headset of a preferred embodiment.
Figure 4B:
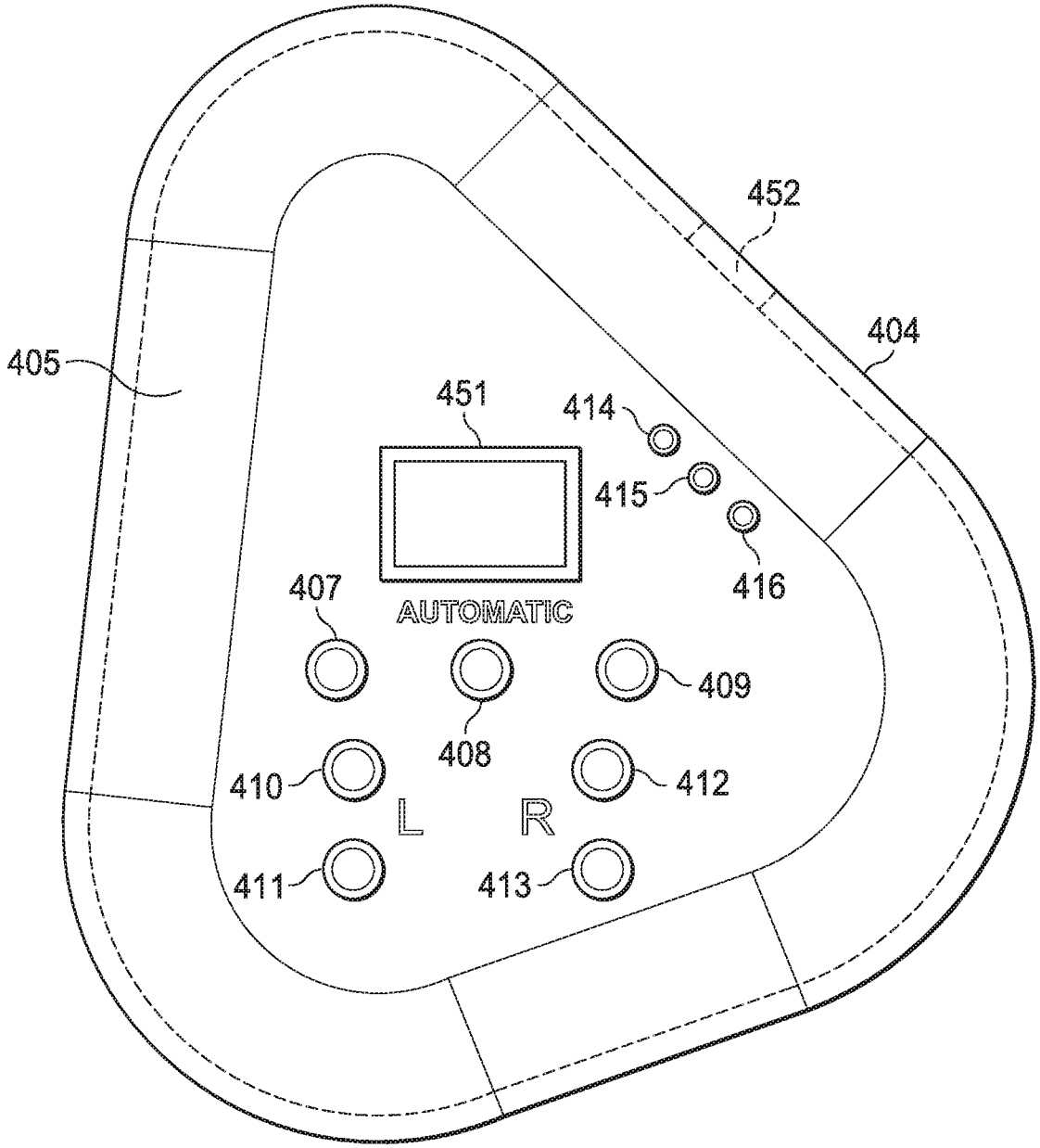
FIG. 4B is a side view of an outer shell of a control earpiece of a headset of a preferred embodiment.
Figure 4C:
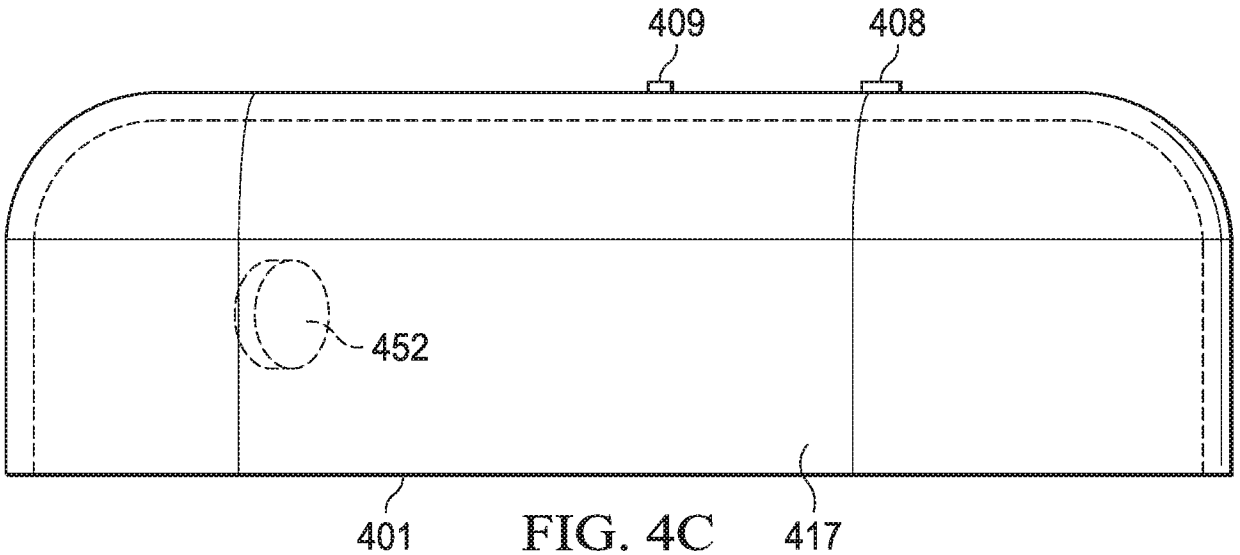
FIG. 4C is an end view of an outer shell of a control earpiece of a headset of a preferred embodiment.

Referring to FIGS. 4A, 4B, and 4C, outer shell 101 will be further described as outer shell 400. Outer shell 400 includes shell 401. Shell 401 includes sides 402, 403, and 404. Transition 406 is attached to each of sides 402, 403, and 404 and outer surface 405 forming shell cavity 417. Outer surface 405 includes display 451, ascent mode button 407, ground level mode button 408, and descent mode button 409. Outer surface 405 further includes left increase pressure button 410, left decrease pressure button 411, right increase pressure button 412, right decrease pressure button 413, low battery LED indicator 414, pressure warning LED indicator 415, and device charged LED indicator 416. Side 404 includes power button 452. Side 403 includes ambient sensor 418. Outer shell 400 provides a housing for a control system to control a pressure as will be further described below.

In a preferred embodiment, outer shell 400 is made of plastic. Other suitable materials known in the art may be employed including metals and metal alloys.

Figure 5A:
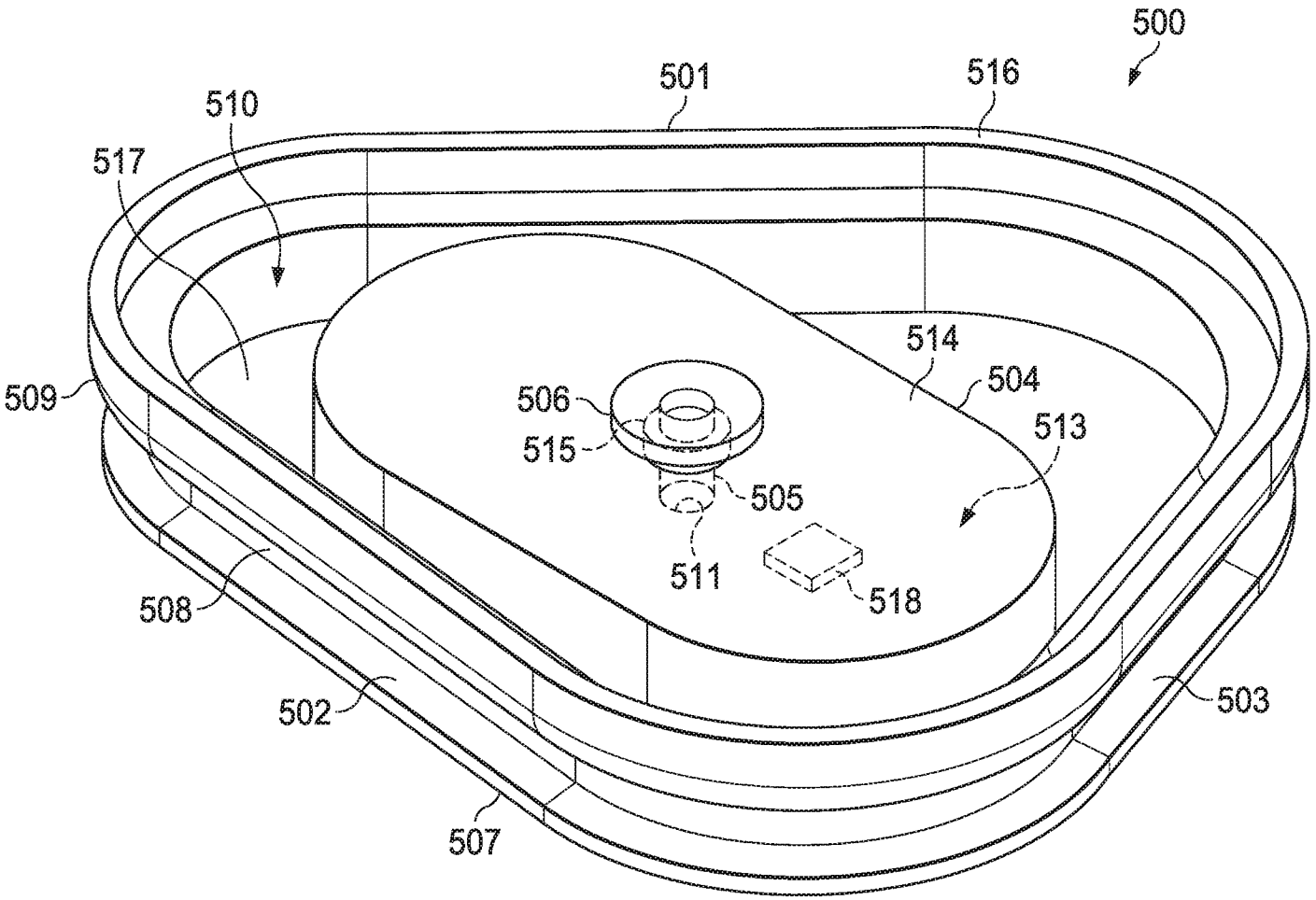
FIG. 5A is an isometric view of an inner shell of a control earpiece of a headset of a preferred embodiment.
Figure 5B:
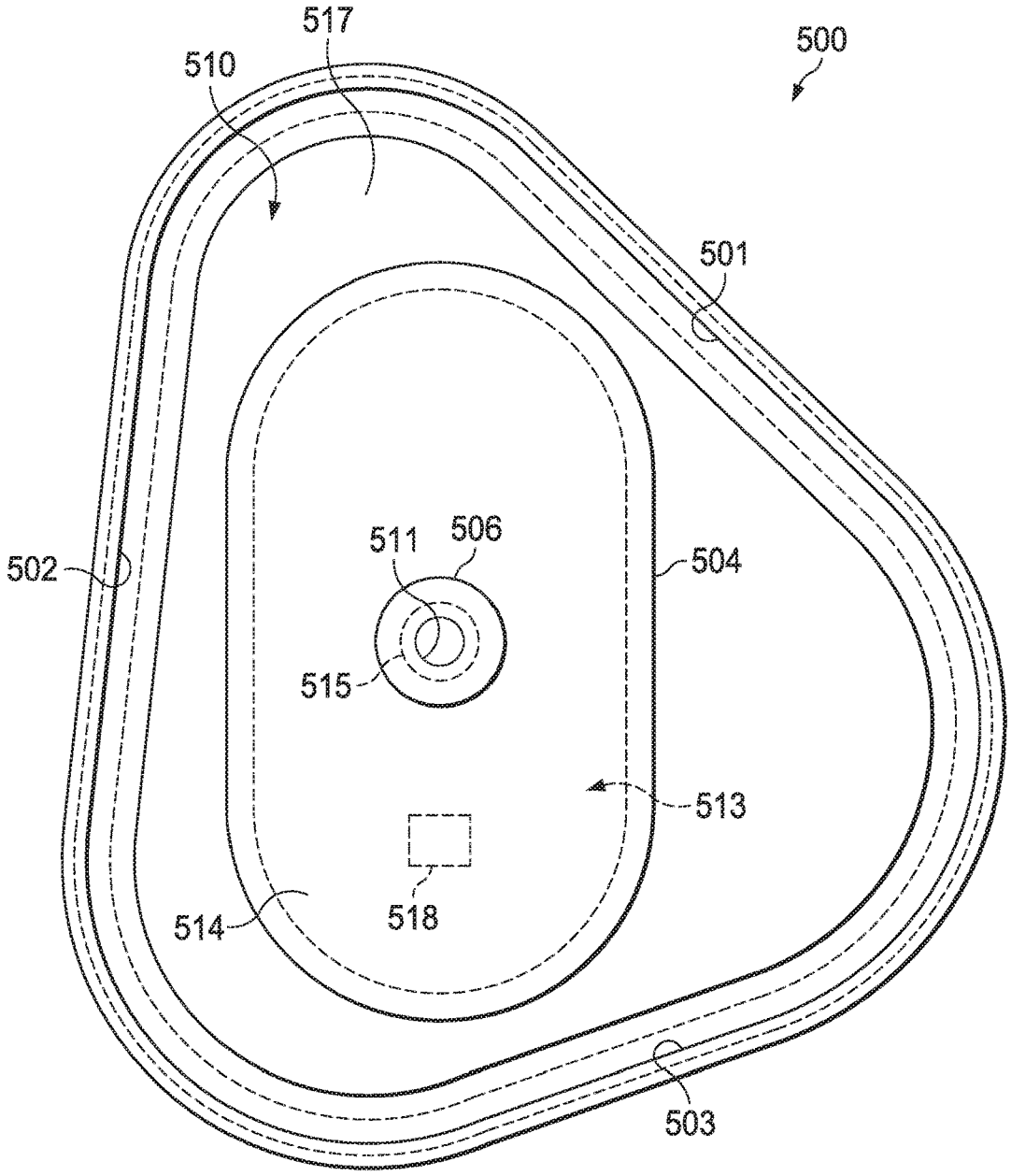
FIG. 5B is a side view of an inner shell of a control earpiece of a headset of a preferred embodiment.
Figure 5C:
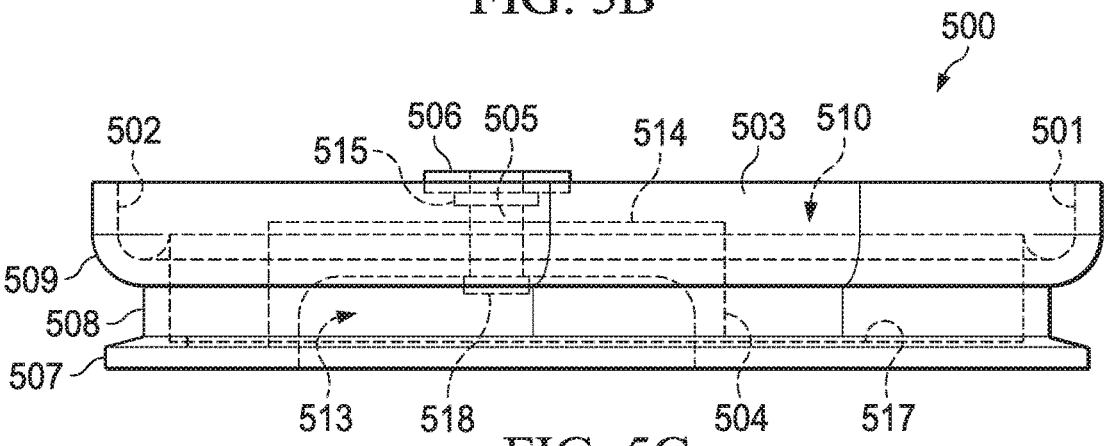
FIG. 5C is an end view of an inner shell of a control earpiece of a headset of a preferred embodiment.

Referring to FIGS. 5A, 5B, 5C, inner shell 102 will be further described as inner shell 500. Inner shell 500 includes sides 501, 502, and 503 and inner surface 517 to form shell cavity 510. Platform 504 includes surface 514 and forms cavity 513 opposite surface 514. Set of pressure sensors 518 is positioned in cavity 513 and in shell cavity 510. Post 505 is attached to platform 504 and has hole 511 that extends through platform 504 into shell cavity 510. Ring 506 is attached to post 505 opposite platform 504. Ring 515 is attached to post 505 and positioned adjacent to ring 506. In a preferred embodiment, ring 515 has a diameter less than a diameter of ring 506. Each of sides 501, 502, and 503 includes annular ring 507, channel 508 attached to annular ring 507, and wall 509 attached to channel 508. Wall 509 includes edge 516, and upon assembly with outer shell 400, is flush with outer shell 400.

In a preferred embodiment, headphone padding is wrapped around annular ring 507 and secured in channel 508 for positioning adjacent an ear. In one embodiment, the headphone padding is frictionally engaged with channel 508. In other embodiments, an adhesive is employed to further secure the headphone padding in channel 508. Any suitable type of securement means known in the art may employed.

In a preferred embodiment, a pump is wrapped around ring 506 such that ring 506 is inserted into the pump as will be further described below. In this embodiment, the pump engages and is secured adjacent to ring 515, preferably with an adhesive to form a substantially airtight attachment.

In a preferred embodiment, inner shell 500 is made of plastic. Other suitable materials known in the art may be employed including metals and metal alloys.

Figure 6A:
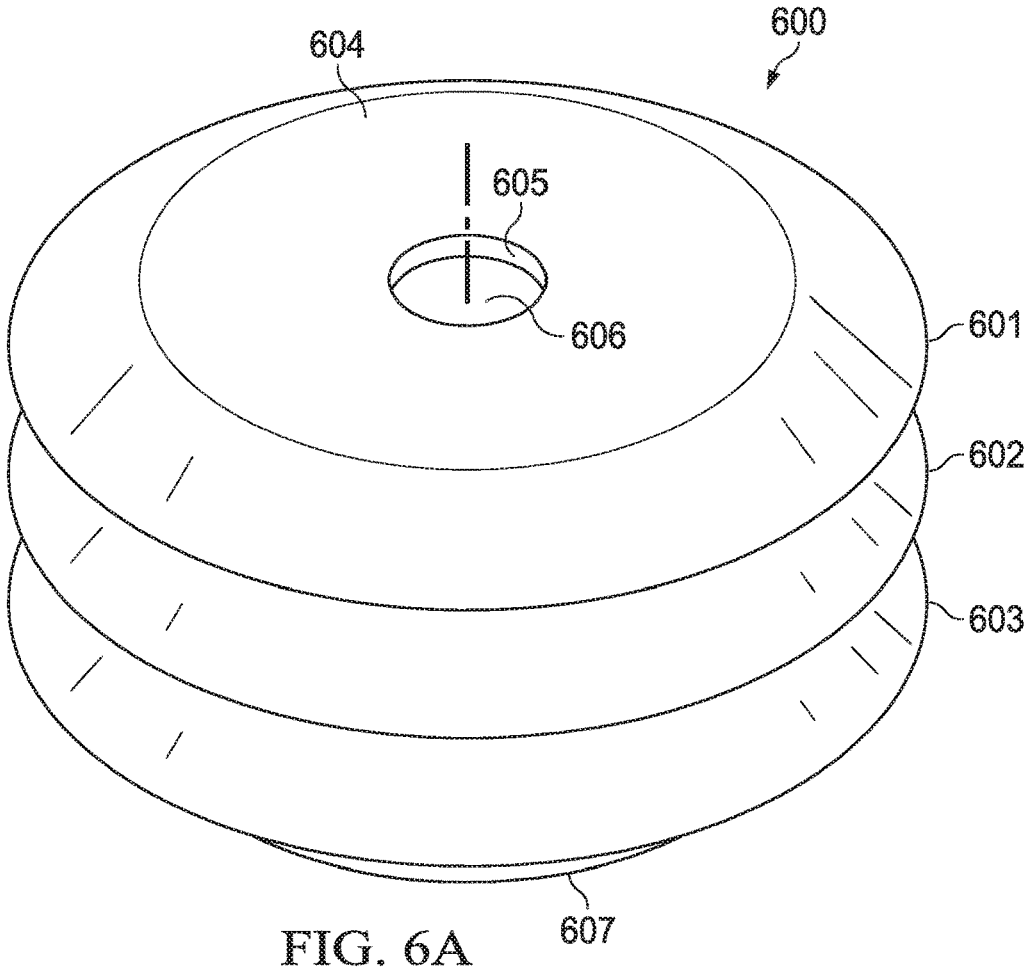
FIG. 6A is a perspective view of a pump of a headset of a preferred embodiment.
Figure 6B:
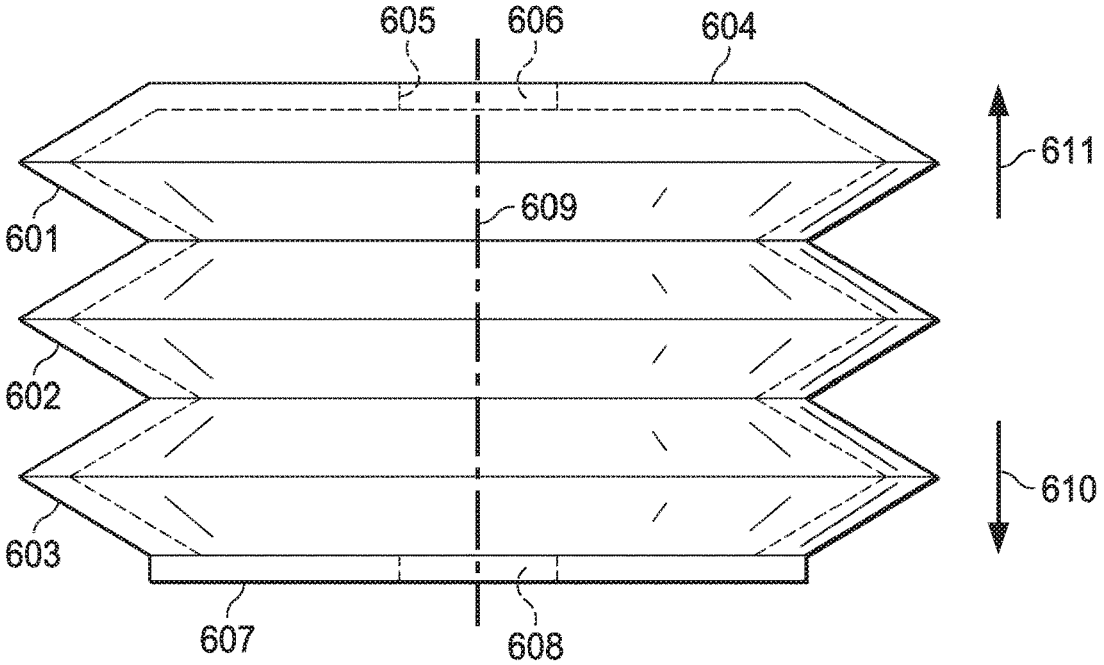
FIG. 6B is a side view of a pump of a headset of a preferred embodiment.

Referring to FIGS. 6A and 6B, pump 600 includes set of pleats 601, 602, and 603. Pleat 601 includes end surface 604. End surface 604 includes port 606 having annular surface 605. Pleat 603 includes end surface 607 opposite end surface 604. End surface 607 includes port 608 through which air moves.

In preferred embodiment, pump 600 is made from a flexible plastic. Other suitable materials known in the art may be employed.

In use, a connector, as will be further described below, is attached to end surface 604 and to a motor. End surface 607 is attached to an inner shell such that port 608 is secured to a post of an inner shell, preferably with an adhesive, to form a substantially airtight connection between pump 600 and the inner shell. The motor is operated such that pump 600 is compressed and decompressed generally along axis 609 in directions 610 and 611, respectively. In this way, pump 600 operates similar to that of an accordion and air is forced out of pump 600 via port 608 into a cavity of an inner shell, for example inner shell 500.

Figure 7B:
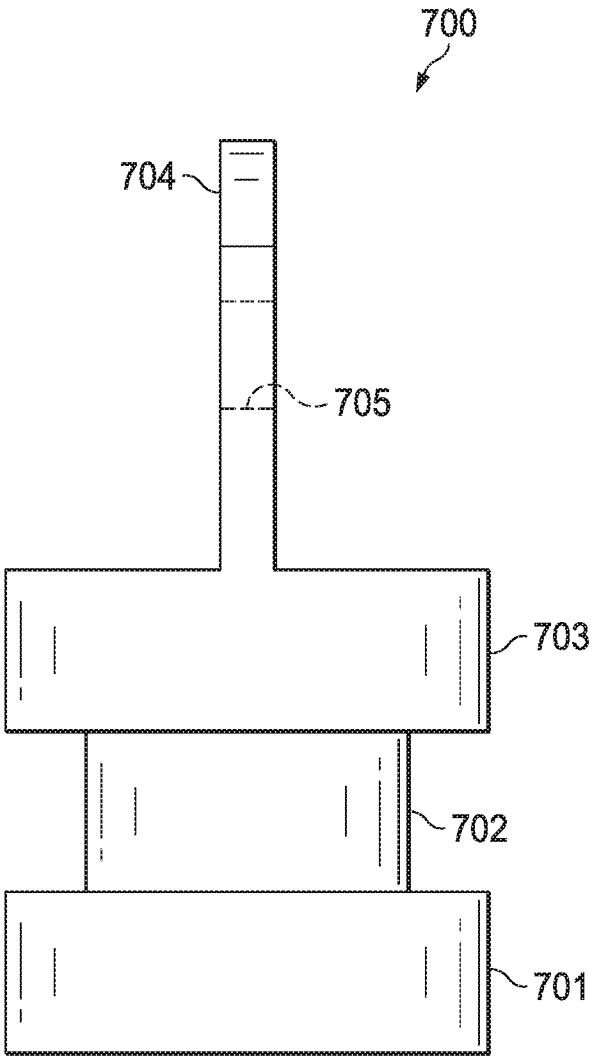
FIG. 7B is a side view of a pump connector of a headset of a preferred embodiment.
Figure 7A:
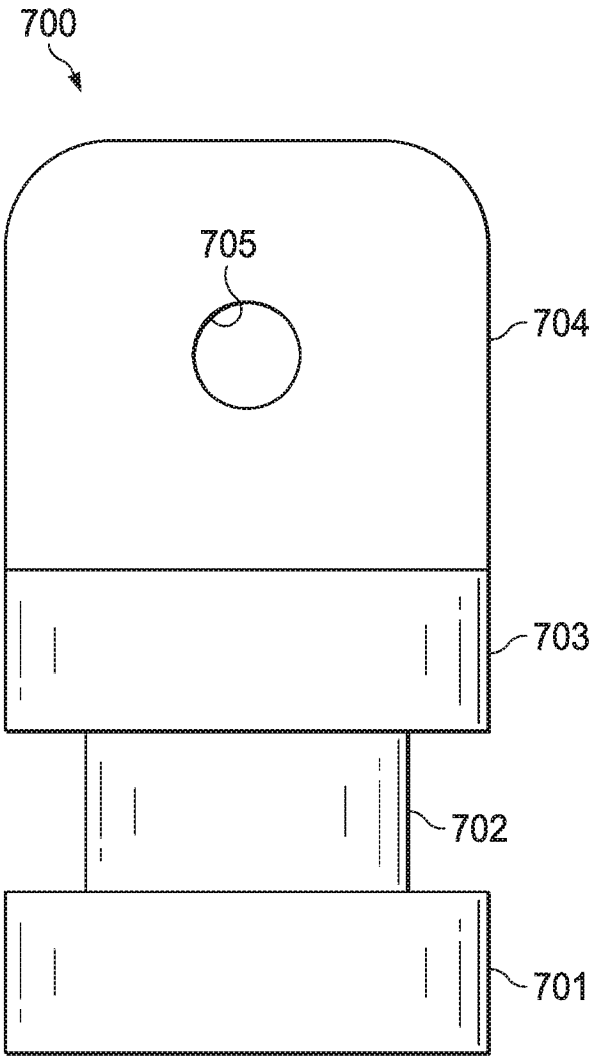
FIG. 7A is a side view of a pump connector of a headset of a preferred embodiment.

Referring to FIGS. 7A and 7B, connector 700 includes annular ring 701, post 702 attached to annular ring 701, annular ring 703 attached to post 702 opposite annular ring 701, and connector plate 704 attached to annular ring 703 opposite post 702. Connector plate 704 includes receiver 705 for receiving a connector rod. The connector rod is also connected to a shaft of a motor.

In one embodiment, the connector rod is connected to the shaft of a motor with a crank arm. In another embodiment, the connector rod has a set of teeth for engagement with a set of gears, which is engaged with a set of teeth attached to the shaft of the motor. Any suitable means of connection known in the art may be employed.

In a preferred embodiment, connector 700 is a single piece made of plastic. Other suitable means of construction known in the art may be employed including without limitation connector 700 is a set of any number of pieces connected together to form connector 700. Other suitable materials known in the art may be employed including metals and metal alloys.

Figure 8A:
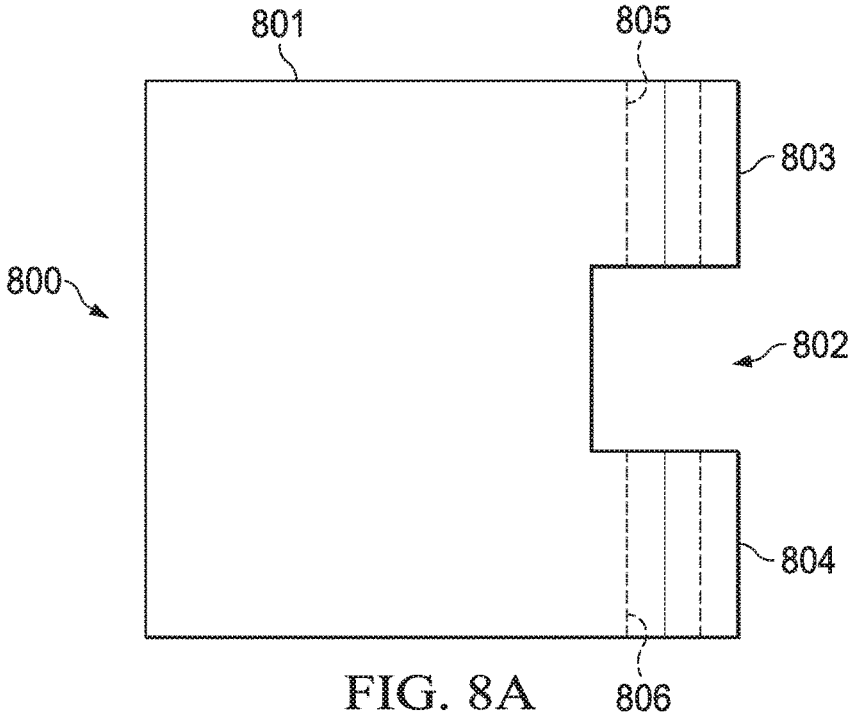
FIG. 8A is a side view of an outer hinge of a headset of a preferred embodiment.
Figure 8B:
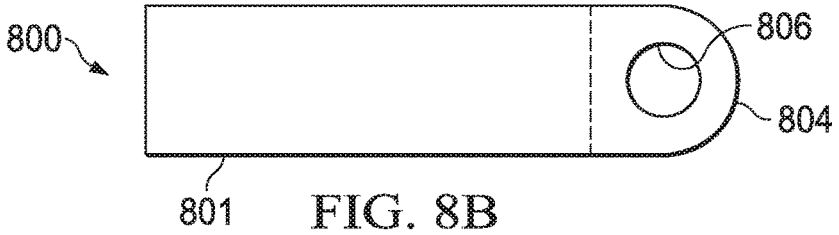
FIG. 8B is a side view of an outer hinge of a headset of a preferred embodiment.

Referring to FIGS. 8A and 8B, hinge plate 800 includes plate 801. Plate 801 includes receiver 802, extension 803 adjacent receiver 802, and extension 804 adjacent receiver 802 opposite extension 803. Extension 803 includes bore 805 extending through extension 803. Extension 804 includes bore 806 extending through extension 804. Bore 805 and bore 806 are axially aligned for receiving a hinge pin. In a preferred embodiment, hinge plate 800 is made of plastic. Other suitable materials known in the art may be employed including metals and metal alloys.

Figure 8C:
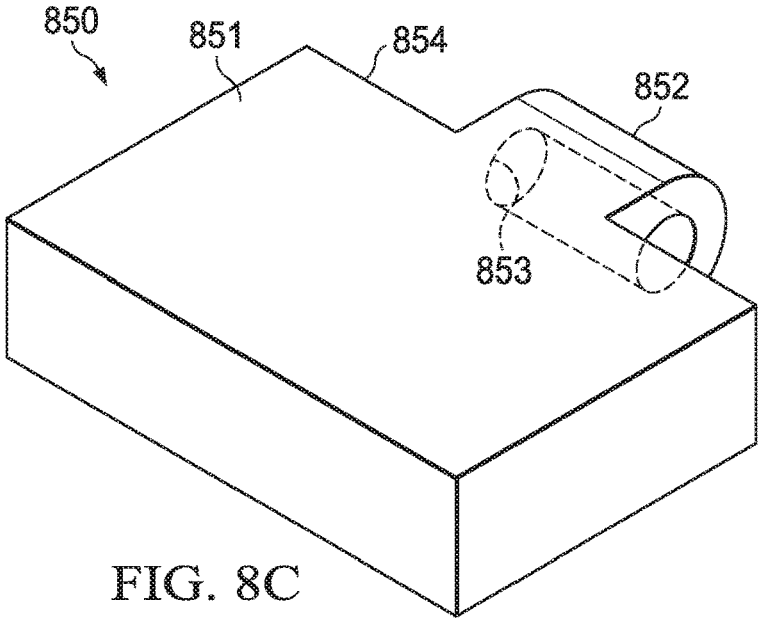
FIG. 8C is an isometric view of an inner hinge of a headset of a preferred embodiment.

Referring to FIG. 8C, hinge plate 850 includes plate 851. Plate 851 includes extension 852 on side 854. Extension 852 has bore 853 extending through extension 852. In a preferred embodiment, extension 852 is generally centrally positioned along side 854. In this embodiment, extension 852 is complementarily received by receiver 802 and pivotally secured with a hinge pin to form a hinge, which connects each of control earpiece 100 and earpiece 200 to headband 300.

Figure 9A:
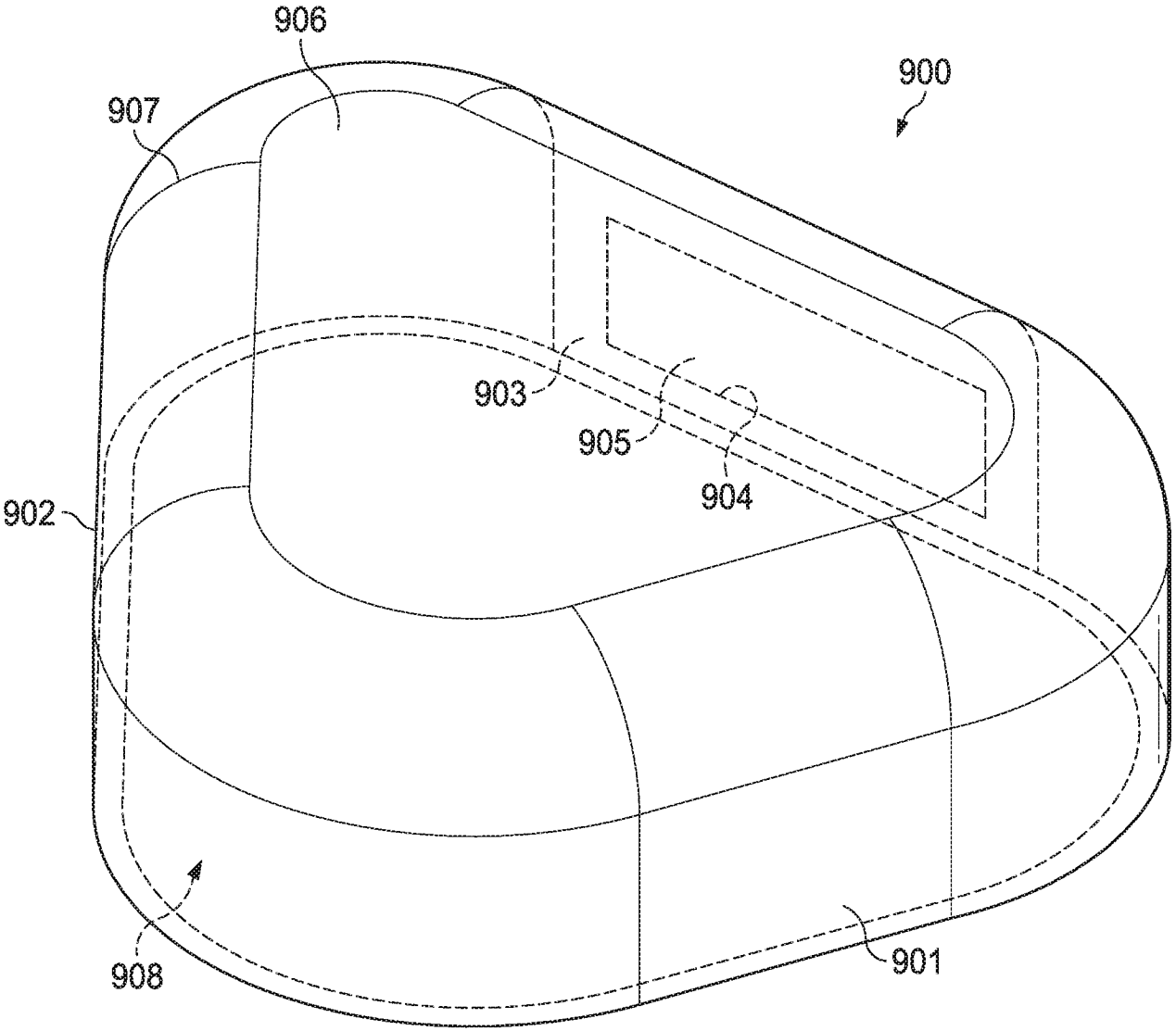
FIG. 9A is an isometric view of an outer shell of an earpiece of a headset of a preferred embodiment.
Figure 9B:
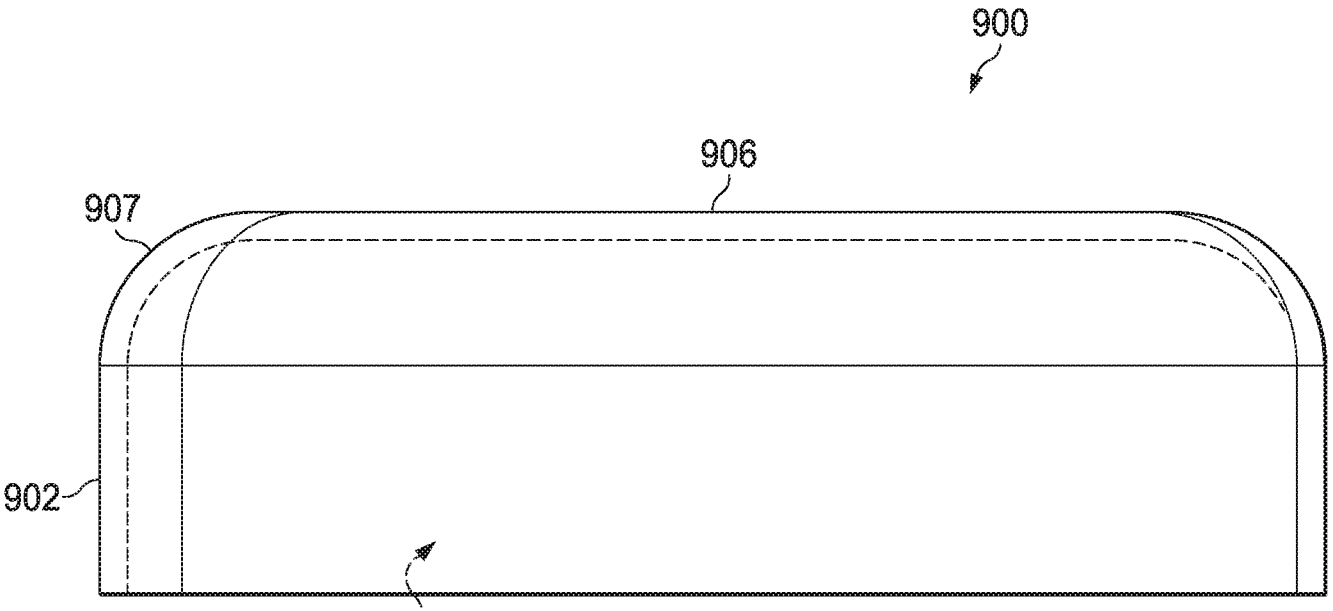
FIG. 9B is an end view of an outer shell of an earpiece of a headset of a preferred embodiment.

Referring to FIGS. 9A and 9B, outer shell 900 includes sides 901, 902, and 903, each of which is attached to outer surface 906 with transition 907 to form outer shell cavity 908. Side 903 includes slot 904 for attachment of display 905. Outer shell 900 provides a housing for a control system to control a pressure as will be further described below.

In a preferred embodiment, outer shell 900 is made of plastic. Other suitable materials known in the art may be employed including metals and metal alloys.

Figure 10A:
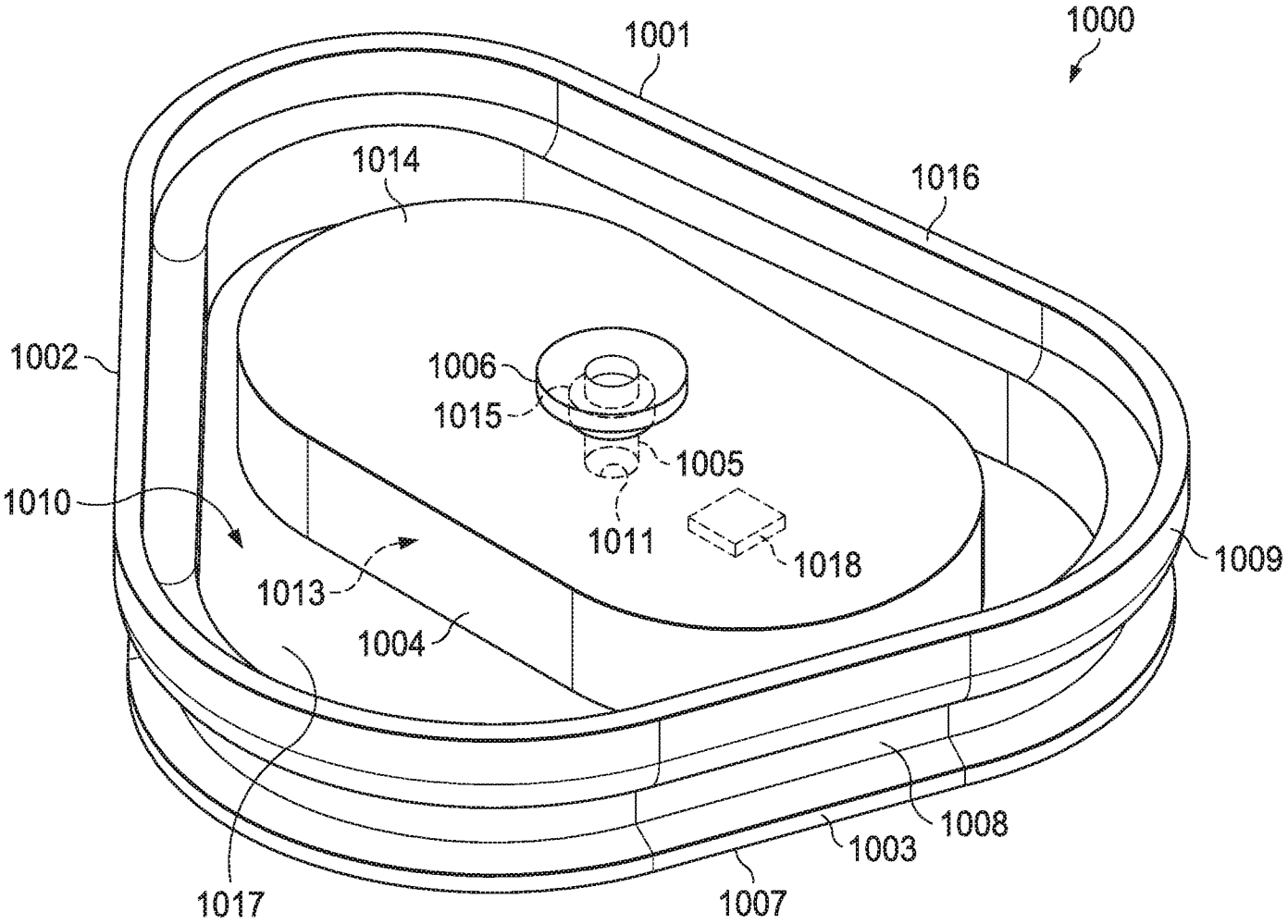
FIG. 10A is an isometric view of an inner shell of an earpiece of a headset of a preferred embodiment.
Figure 10B:
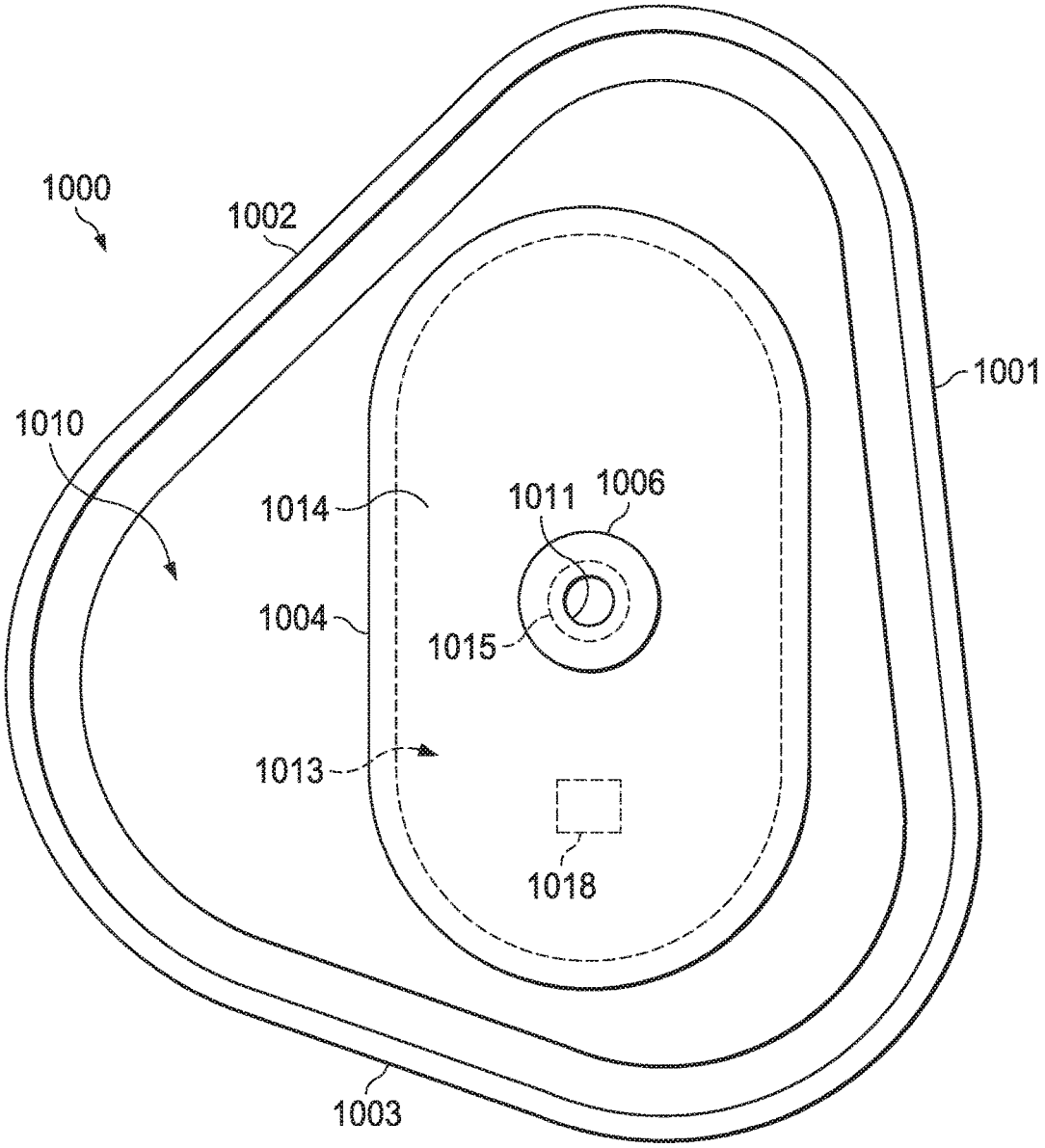
FIG. 10B is a side view of an inner shell of an earpiece of a headset of a preferred embodiment.
Figure 10C:
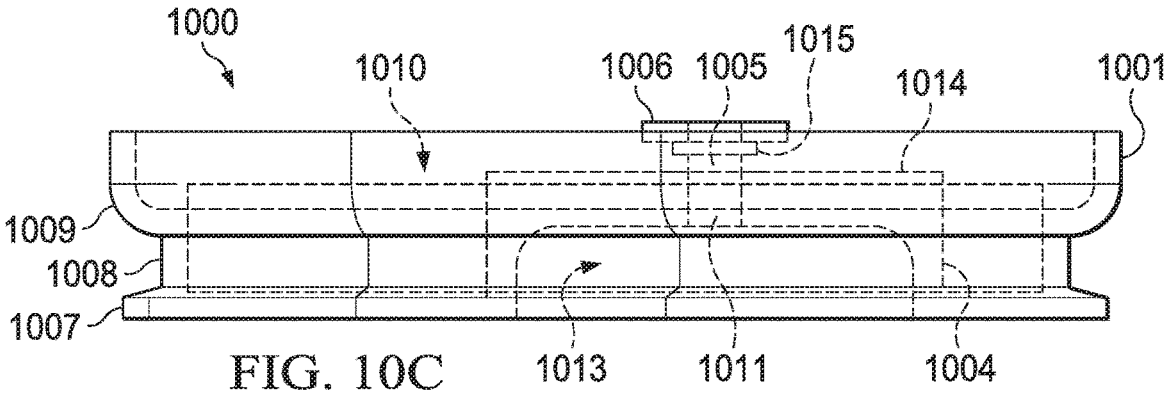
FIG. 10C is an end view of an inner shell of an earpiece of a headset of a preferred embodiment.

Referring to FIGS. 10A, 10B, 10C, inner shell 202 will be further described as inner shell 1000. Inner shell 1000 is substantially the same as inner shell 500. Inner shell 1000 includes sides 1001, 1002, and 1003 and inner surface 1017 to form shell cavity 1010. Platform 1004 includes surface 1014 and forms cavity 1013 opposite surface 1014. Set of position sensors 1018 is positioned in cavity 1013 and in shell cavity 1010. Post 1005 is attached to platform 1004 and has hole 1011 that extends through platform 1004 into shell cavity 1010. Ring 1006 is attached to post 1005 opposite platform 1004. Ring 1015 is attached to post 1005 and positioned adjacent to ring 1006. In a preferred embodiment, ring 1015 has a diameter less than a diameter of ring 1006. Each of sides 1001, 1002, and 1003 includes annular ring 1007, channel 1008 attached to annular ring 1007, and wall 1009 attached to channel 1008. Wall 1009 includes edge 1016 and upon assembly with outer shell 900 is flush with outer shell 900.

In a preferred embodiment, headphone padding is wrapped around annular ring 1007 and secured in channel 1008 for positioning adjacent an ear. In one embodiment the headphone padding is frictionally engaged with channel 1008. In other embodiments, an adhesive is employed to further secure the headphone padding in channel 1008. Any suitable type of securement means known in the art may employed.

In a preferred embodiment, a pump is wrapped around ring 1006 such that ring is inserted into the pump in substantially the same manner as that described with respect to inner shell 500. In this embodiment, the pump engages and is secured adjacent to ring 1015, preferably with an adhesive to form a substantially airtight attachment.

In a preferred embodiment, inner shell 1000 is made of plastic. Other suitable materials known in the art may be employed including metals and metal alloys.

Figure 11:
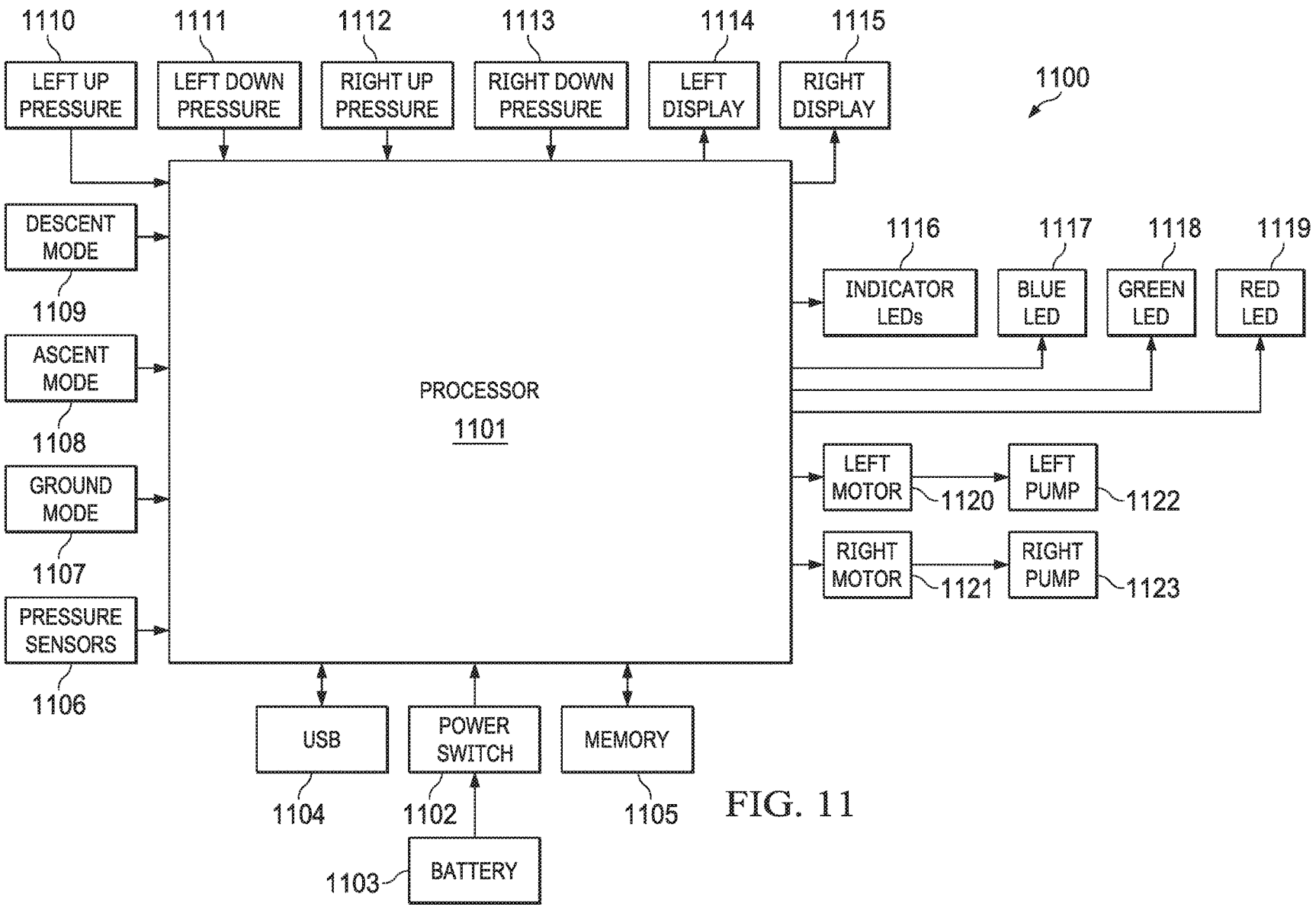
FIG. 11 is a block diagram of a control system of a headset of a preferred embodiment.

Referring to FIG. 11, control system 1100 includes processor 1101, power switch 1102 connected to processor 1101, battery 1103 connected to power switch 1102, USB port 1104 connected to processor 1101, and memory 1105 connected to processor 1101. Control system 1100 further includes a set of pressure sensors 1106 connected to processor 1101, ground mode button 1107 connected to processor 1101, ascent mode button 1108 connected to processor 1101, and descent mode button 1109 connected to processor 1101. Each of left increase pressure button 1110, left decrease pressure button 1111, right increase pressure button 1112, and right decrease pressure button 1113 is connected to processor 1101. Left display 1114 is connected to processor 1101. Right display 1115 is connected to processor 1101. A set of indicator LEDs 1116 is connected to processor 1101. Set of indicator LEDs 1116 corresponds to low battery LED indicator 414, pressure warning LED indicator 415, and device charged LED indicator 416. Blue LED 1117 is connected to processor 1101. Green LED 1118 is connected to processor 1101. Red LED 1119 is connected to processor 1101. Left motor 1120 is connected to processor 1101. Left pump 1122 is connected to left motor 1120. Right motor 1121 is connected to processor 1101. Right pump 1123 is connected to processor 1101.

In a preferred embodiment, processor 1101 is a TinyDuino Processor Board. Other suitable processors known in the art may be employed.

In a preferred embodiment, power switch 1102 is a tactile switch button having a diameter of approximately 12 millimeters and a height of approximately 6 millimeters. Other suitable switches or buttons known in the art may be employed.

In a preferred embodiment, battery 1103 is a lithium ion battery having a capacity of approximately 270 mAh. Other suitable batteries known in the art may be employed.

In a preferred embodiment, USB port 1104 is a USB TinyShield port. Other suitable data transfer ports known in the art may be employed.

In a preferred embodiment, memory 1105 is a 64 GB flash memory. Other suitable memory known in the art may be employed.

In a preferred embodiment, each pressure sensor of set of pressure sensors 1106 is a Bosch BMP280 pressure sensor. Other suitable pressure sensors known in the art may be employed.

In a preferred embodiment, each of ground mode button 1107, ascent mode button 1108, and descent mode button 1109 is a tactile switch button having a diameter of approximately 12 millimeters and a height of approximately 6 millimeters. Other suitable switches or buttons known in the art may be employed.

In a preferred embodiment, each of left increase pressure button 1110, left decrease pressure button 1111, right increase pressure button 1112, and right decrease pressure button 1113 is a tactile switch button having a diameter of approximately 12 millimeters and a height of approximately 6 millimeters. Other suitable switches or buttons known in the art may be employed.

In a preferred embodiment, each of left display 1114 and right display 1115 is a TinyScreen OLED TinyShield screen. Other suitable displays known in the art may be employed.

In a preferred embodiment, each of set of indicator LEDs 1116 is a diffused 3 millimeter LED of any color. Other suitable LEDs known in the art may be employed.

In a preferred embodiment, blue LED 1117 is a diffused 3 millimeter blue LED. Other suitable LEDs known in the art may be employed.

In a preferred embodiment, green LED 1118 is a diffused 3 millimeter green LED. Other suitable LEDs known in the art may be employed.

In a preferred embodiment, red LED 1119 is a diffused 3 millimeter red LED. Other suitable LEDs known in the art may be employed.

In a preferred embodiment, each of left motor 1120 and right motor 1121 is a brushed DC pager motor (RPM2). In another embodiment, each of left motor 1120 and right motor 1121 is a small reduction stepper motor with 5V DC 32-step 1/16 gearing. Other suitable motors known in the art may be employed.

In a preferred embodiment, each of pumps 1122 and 1123 is pump 600. Other suitable pumps known in the art may be employed.

In a preferred embodiment, a set of instructions is stored in memory 1105 and executed by processor 1101. A set of data is further received and stored in memory 1105, including preset, saved, and detected pressure levels. The set of instructions receives and examines any of a set of input signals from set of pressure sensors 1106, ground mode button 1107, ascent mode button 1108, descent mode button 1109, left increase pressure button 1110, left decrease pressure button 1111, right increase pressure button 1112, and right decrease pressure button 1113 and executes the set of instruction based any number of the set of input signals to generate a set of output signals that operates any of left display 1114, right display 1115, set of indicator LEDs 1116, blue LED 1117, green LED 1118, and red LED 1119. The set of output signals operate any of left motor 1120 and right motor 1121, thereby operating any of left pump 1122 and 1123, respectively.

In a preferred embodiment, the set of instructions is programmed using the Arduino software in C/C++ programming language. In another embodiment, the set of instructions is programmed using the JavaScript programming language. Other suitable programming languages known in the art may be employed.

Figure 12:
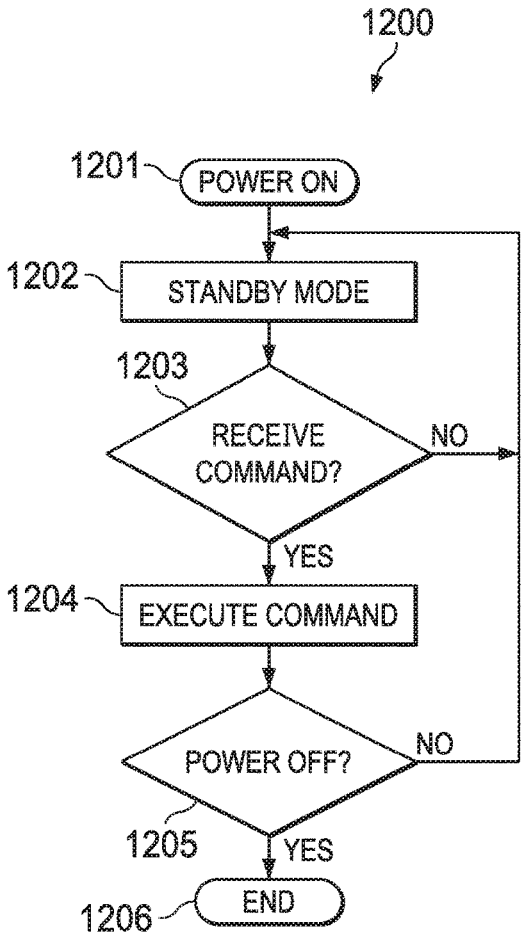
FIG. 12 is a flowchart of a method for operating a headset of a preferred embodiment.

Referring to FIG. 12, method 1200 for operating a headset will be described. At step 1201, power to the headset is turned on. At step 1202, the headset enters a standby mode awaiting a command. At step 1203, whether a command is received is determined. A command is an input signal, by way of example, from an ascent mode button to execute an ascent mode as will be further describe below or as another non-limiting example, a signal to increase or decrease pressure on the left or right earpiece. If a command is received at step 1203, then the command is executed at step 1204. In a preferred embodiment, each of an increase and decrease command for either the left or right earpiece adjusts the pressure by an increment of approximately 10 hPa. Other suitable pressure increments may be employed. If no command is received at step 1203, then method 1200 returns to standby mode at step 1202.

At step 1205, whether a power off command is received is determined. If not, then method 1200 returns to standby mode at step 1202. If so, then method 1200 ends and powers off at step 1206.

Figure 13:
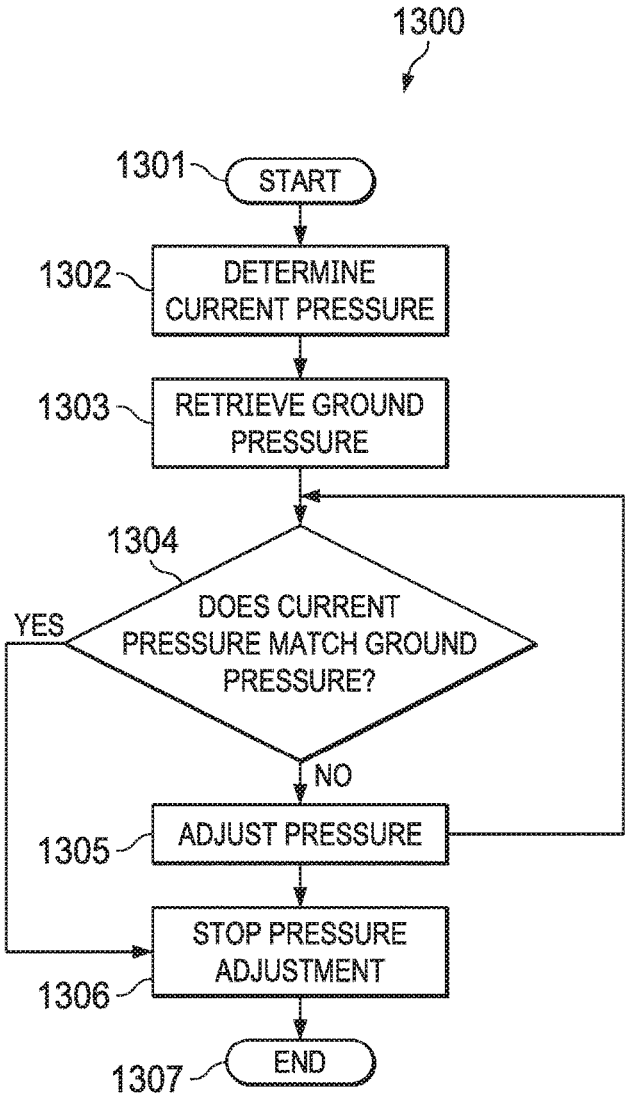
FIG. 13 is a flowchart of a method of implementing a ground pressure mode on a headset of a preferred embodiment.

Referring to FIG. 13, method 1300 for implementing a ground pressure mode is described and starts at step 1301. At step 1302, a current ambient pressure is determined from a set of pressure sensors. At step 1303, a predetermined ground pressure is retrieved from memory. In a preferred embodiment, the predetermined ground pressure is set by a user on first use and varies from each geographic location of the user. For example, the ground pressure in Denver, Colo. will be different from the ground pressure in Frisco, Tex. In other embodiments, the predetermined ground pressure is preset. In these embodiments, the predetermined ground pressure is approximately 101.325 kPa, approximately 1 atm.

At step 1304, the current ambient pressure is compared to the predetermined ground pressure to determine whether the current ambient pressure matches the predetermined ground pressure. In a preferred embodiment, a match is determined when the current ambient range is within a predetermined error or tolerance range of the predetermined ground pressure. Other means for comparing and matching data known in the art may be employed. If no match is determined at step 1304, then method 1300 proceeds to step 1305. At step 1305, a pressure of each earpiece is adjusted by increasing and/or decreasing the pressure in each ear piece by activating each pump motor in each earpiece thereby activating each pump in each earpiece to change the pressure in each earpiece. Method 1300 returns to step 1304. If a match is determined at step 1304, then method 1300 proceeds to step 1306 where the pressure adjustment stops. Method 1300 ends at step 1307.

Figure 14:
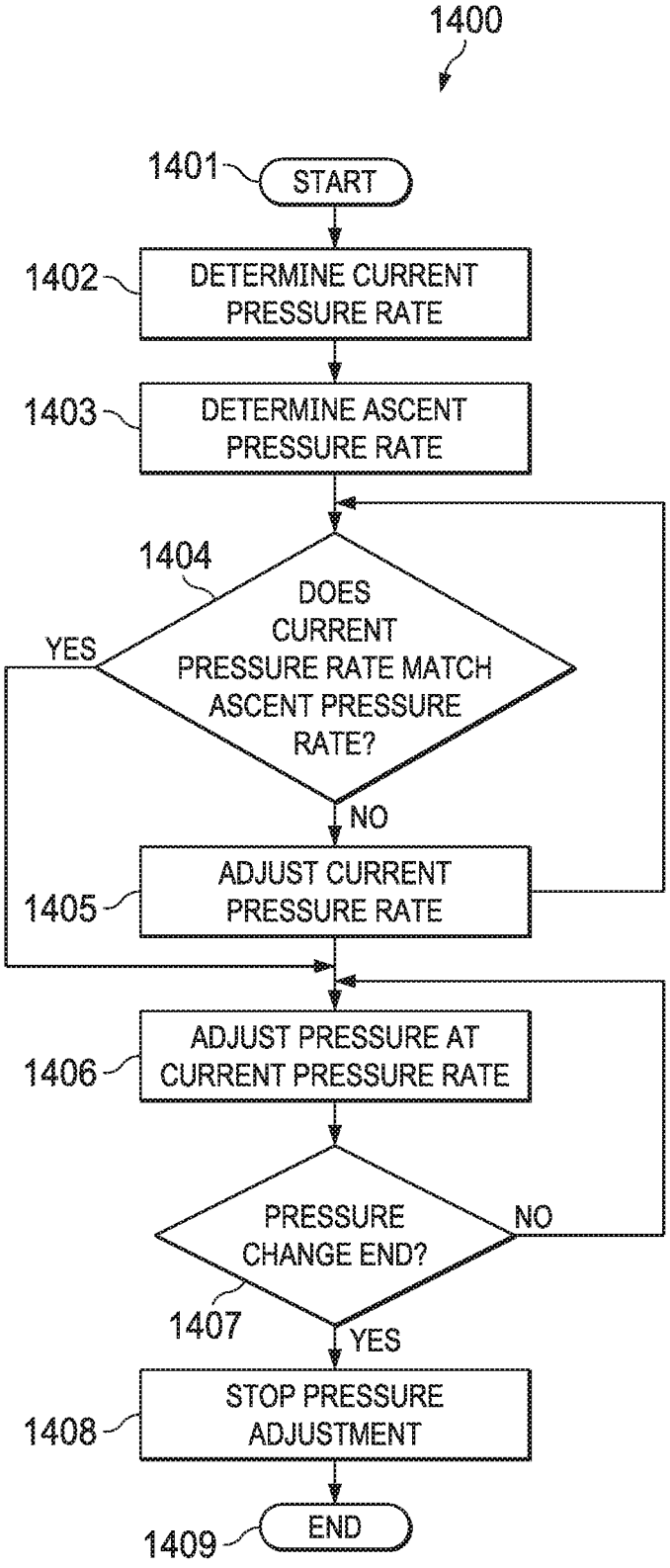
FIG. 14 is flowchart of a method of implementing an ascent pressure mode on a headset of a preferred embodiment.

Referring to FIG. 14, method 1400 for implementing an ascent pressure on a headset is described and begins at step 1401. At step 1402, a current pressure rate in the headset is determined from a set of pressure sensors. At step 1403, an ambient ascent pressure rate is determined from the set of pressure sensors. At step 1404, the current pressure rate is compared to the ambient ascent pressure rate to determine whether the current pressure rate matches the ambient ascent pressure rate. In a preferred embodiment, a match is determined when the current pressure rate is within a predetermined error or tolerance range of the ambient ascent pressure rate. Other means for comparing and matching data known in the art may be employed. If no match is determined at step 1404, then the current pressure rate in the headset is adjusted at step 1405 and then method 1400 returns to step 1404. If a match is determined at step 1404, then method 1400 proceeds to step 1406 where the pressure in the headset is adjusted at the current pressure rate in each ear piece by activating each pump motor in each earpiece thereby activating each pump in each earpiece to change the pressure in each earpiece. In this step, the pressure is decreased according to the current pressure rate.

At step 1407, whether the ambient pressure change has ended is determined from the set of pressure sensors. If not, then method 1400 returns to step 1406. If so, then method 1400 proceeds to step 1408 where the adjustment of the pressure in the headset is stopped. Method 1400 then ends at step 1409 and returns to a standby mode.

Figure 15:
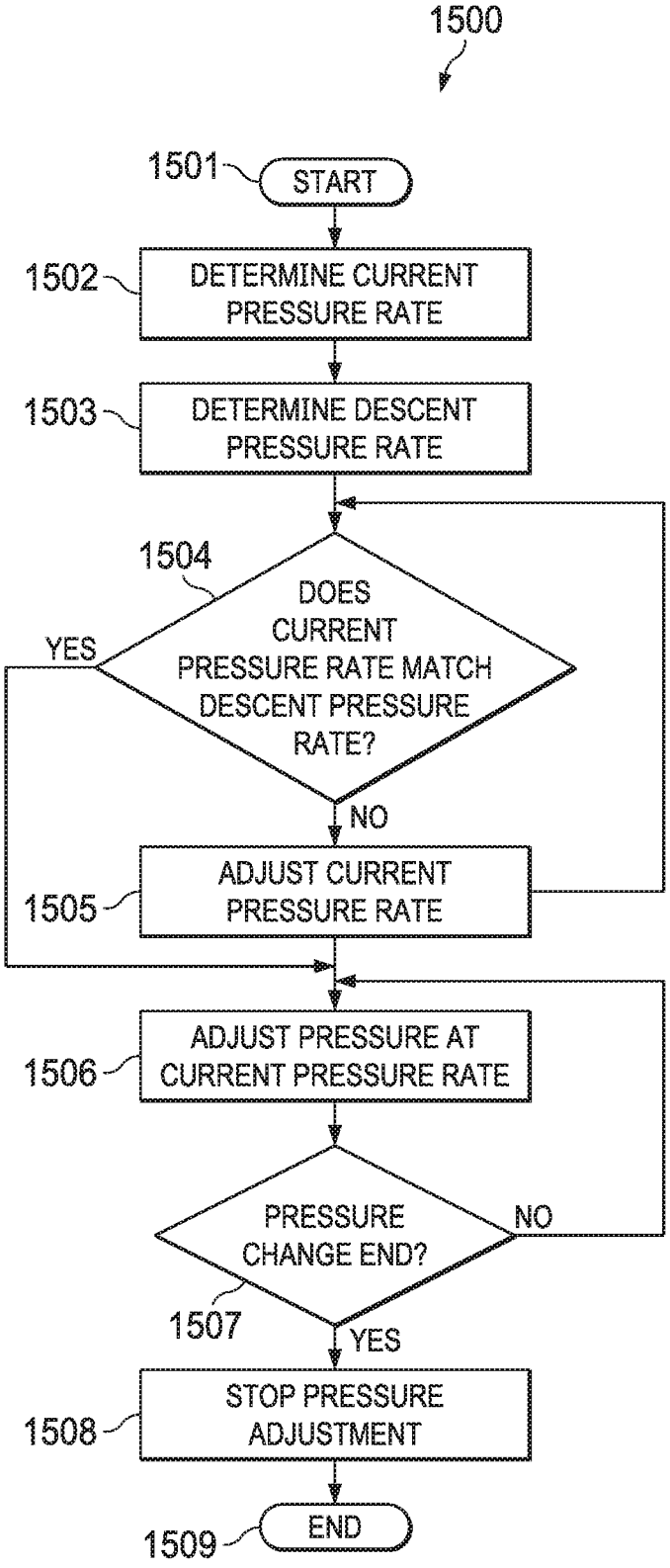
FIG. 15 is a flowchart of method of implementing a descent pressure mode on a headset of a preferred embodiment.

Referring to FIG. 15, method 1500 for implementing a descent pressure on a headset is described and begins at step 1501. At step 1502, a current pressure rate in the headset is determined from a set of pressure sensors. At step 1503, an ambient descent pressure rate is determined from the set of pressure sensors. At step 1504, the current pressure rate is compared to the ambient descent pressure rate to determine whether the current pressure rate matches the ambient descent pressure rate. In a preferred embodiment, a match is determined when the current pressure rate is within a predetermined error or tolerance range of the ambient descent pressure rate. Other means for comparing and matching data known in the art may be employed. If no match is determined at step 1504, then the current pressure rate in the headset is adjusted at step 1505 and then method 1500 returns to step 1504. If a match is determined at step 1504, then method 1500 proceeds to step 1506 where the pressure in the headset is adjusted at the current pressure rate in each ear piece by activating each pump motor in each earpiece thereby activating each pump in each earpiece to change the pressure in each earpiece. In this step, the pressure is increased according to the current pressure rate.

At step 1507, whether the ambient pressure change has ended is determined from the set of pressure sensors. If not, then method 1500 returns to step 1506. If so, then method 1500 proceeds to step 1508 where the adjustment of the pressure in the headset is stopped. Method 1500 then ends at step 1509 and returns to a standby mode.

Figure 16:
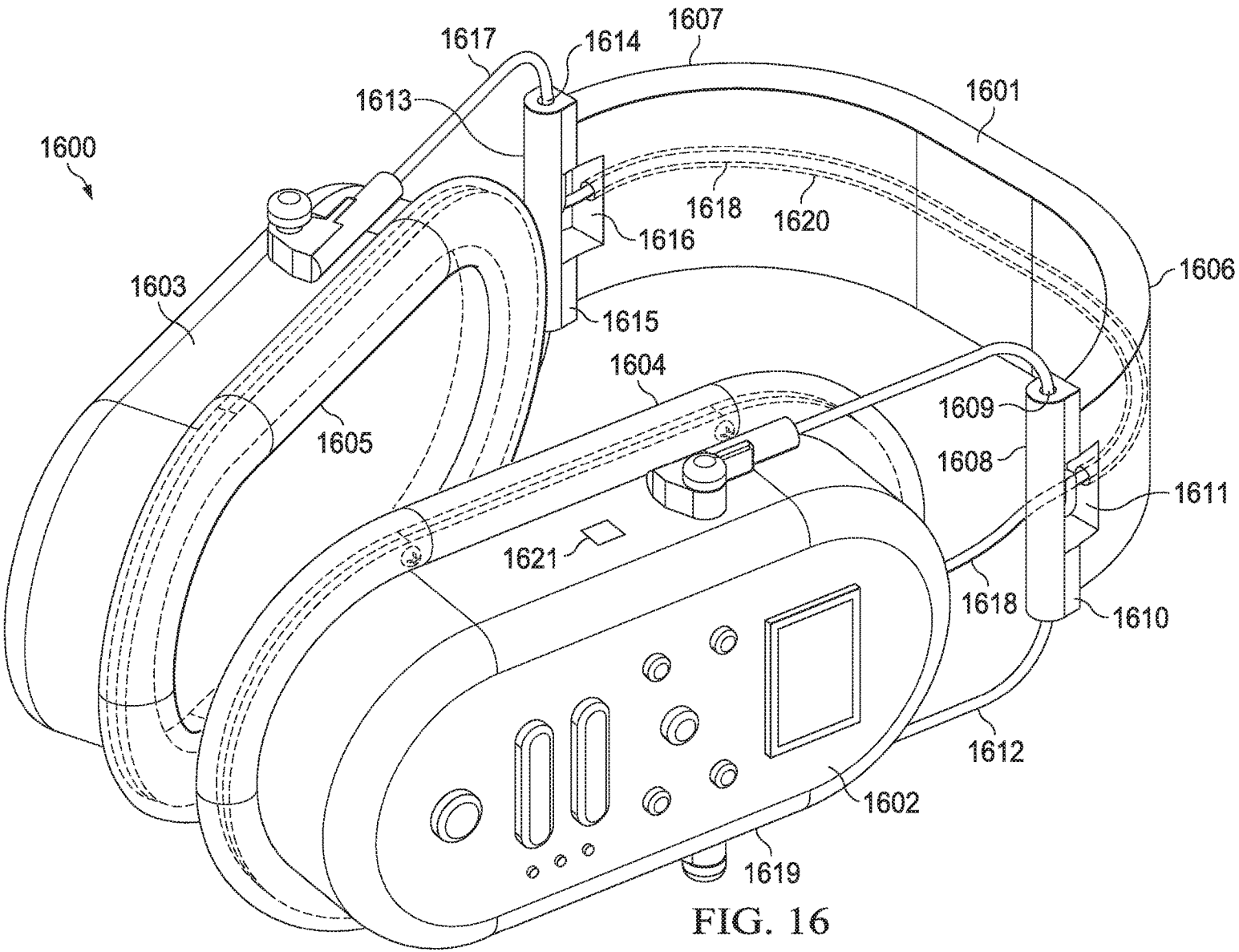
FIG. 16 is an isometric view of a headset of a preferred embodiment.

Referring to FIG. 16 in another embodiment, headset 1600 includes headband 1601, control earpiece 1602 movably connected to headband 1601, and earpiece 1603 movably connected to headband 1601. Annular pad 1604 is attached to control earpiece 1602 with a suitable adhesive or other suitable attachment means known in the art. Annular pad 1605 is attached to earpiece 1603 with a suitable adhesive or other suitable attachment means known in the art.

Headband 1601 includes connector portions 1606 and 1607. Connector portion 1606 includes connector 1608 having bore 1609 sized to accommodate wire 1612 of control earpiece 1602. Connector 1608 is attached connector mount 1610. Connector portion 1606 further includes opening 1611 sized to accommodate a tab of wire 1612 and to prevent movement of wire 1612 in opening 1611 in a direction generally along bore 1609.

Connector portion 1607 includes connector 1613 having bore 1614 sized to accommodate wire 1617 of earpiece 1603. Connector 1613 is attached connector mount 1615. Connector portion 1607 further includes opening 1616 sized to accommodate a tab of wire 1617 and to prevent movement of wire 1617 in opening 1616 in a direction generally along bore 1614.

Cable 1618 connects control earpiece 1602 to earpiece 1603 through passage 1620 in headband 1601. Cable 1618 enables data and power to be sent and received between control earpiece 1602 and earpiece 1603. Control earpiece 1602 includes power port 1619 and ambient pressure sensor 1621.

In some embodiments, a pad is attached to headband 1601 to provide comfort for a user.

In a preferred embodiment, headband 1601 is made of a suitable plastic. Other materials known in the art may be employed.

In a preferred embodiment, each of annular pad 1604 and 1605 is made of a suitable foam and covered with a plastic cover such that when in use each of annular pads 1604 and 1605 provides a substantial seal between the cover and the skin of the user. Other suitable materials known in the art may be employed.

In a preferred embodiment, cable 1618 is a USB 3.0 cable. Other suitable data and power cables known in the art may be employed.

Figure 17:
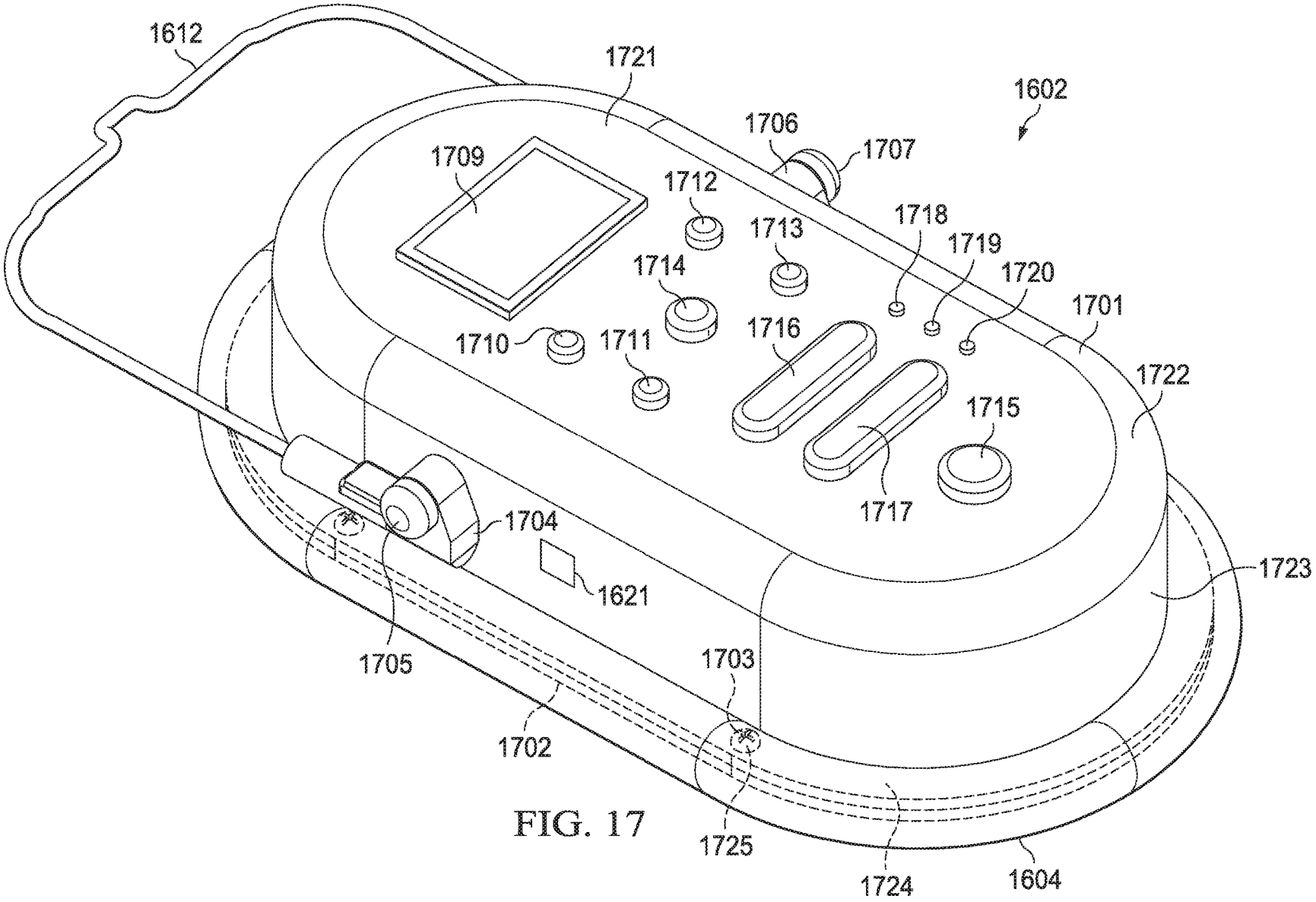
FIG. 17 is an isometric view of a control earpiece of a headset of a preferred embodiment.

Referring to FIG. 17, control earpiece 1602 includes outer shell 1701 connected to inner shell 1702 with set of fasteners 1703. Connector 1704 is movably connected to outer shell 1701 with pin 1705. Connector 1706 is movably connected to outer shell 1701 with pin 1707. Wire 1612 is slidably engaged with each of connectors 1704 and 1706. Outer shell 1701 includes display 1709, left pressure up button 1710, left pressure down button 1711, right pressure button 1712, right pressure down button 1713, and ground level mode button 1714. Outer shell 1701 further includes power button 1715, ascent mode button 1716, descent mode button 1717, pressure warning LED indictor 1718, low battery LED indicator 1719, and device charged LED indicator 1720.

Outer shell 1701 includes outer surface 1721, transition 1722, annular side 1713, and annular ring 1724. Annular ring 1724 includes a set of holes 1725, each of which is sized to accommodate a corresponding fastener of set of fasteners 1703. Annular pad 1604 is attached to annular ring 1724 and an annular ring of inner shell 1702.

In a preferred embodiment, control earpiece 1602 has a generally oval shape and is sized to fit over the ear of a user. Other suitable shapes, sizes, and fits known in the art may be employed, including ear bud styles.

In a preferred embodiment, outer shell 1701 is made of plastic. Other suitable materials known in the art may be employed including metal and metal alloys.

Figure 18:
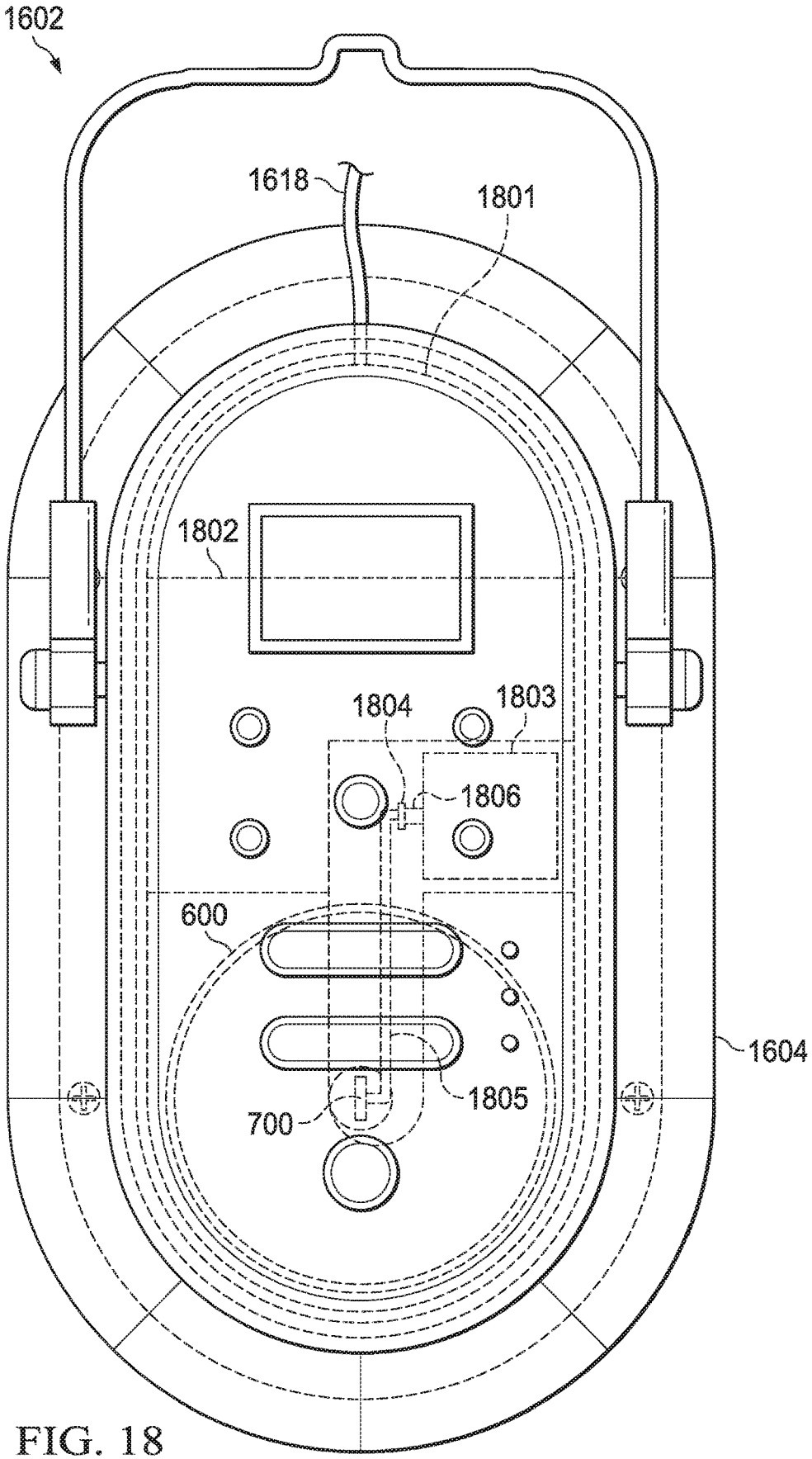
FIG. 18 is a side sectional view of a control earpiece of a headset of a preferred embodiment.
Figure 19:
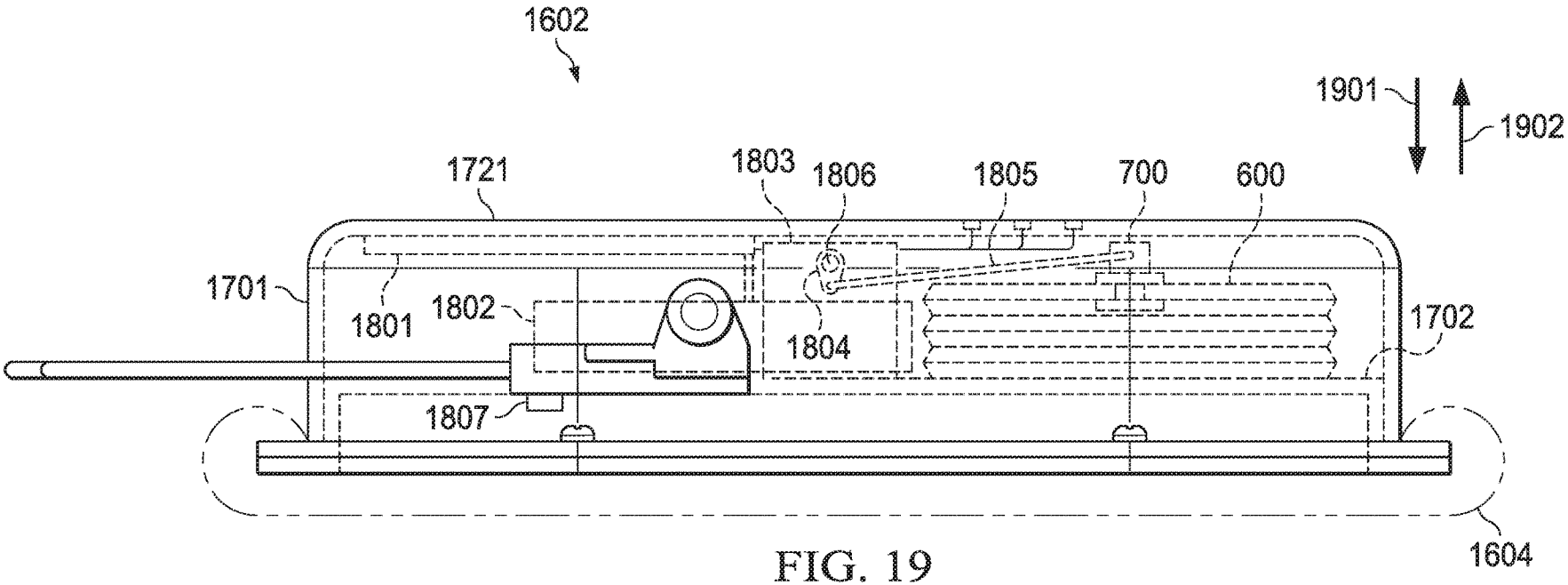
FIG. 19 is a side sectional view of a control earpiece of a headset of a preferred embodiment.

Referring to FIGS. 18 and 19, control earpiece 1602 further includes board 1801 connected to surface 1721 and battery 1802 switchably connected to board 1801 and connected to inner shell 1702. Set of pressure sensors 1807 is attached to the inside of inner shell 1702 and connected to board 1801. Motor 1803 includes shaft 1806 and is operably connected to board 1801. Crank arm 1804 is rotatably connected to shaft 1806 of motor 1803 and connector rod 1805 is rotatably connected to crank arm 1804. Connector 700 is rotatably connected to connector rod 1805 and connected to pump 600. Pump 600 is connected to inner shell 1702. Cable 1618 is connected to board 1801.

In use, board 1801 controllably provides power from battery 1802 to motor 1803. Motor 1803 rotates shaft 1806, and through crank arm 1804, connector rod 1805 and connector 700 moves pump 600 back and forth generally along directions 1901 and 1902 to provide air pressure in inner shell 1702 which is immediately adjacent to an ear of a user. Board 1801 further provides power and data and receives data through cable 1618. Cable 1618 is connected to earpiece 1603. Set of pressure sensors 1807 provides data to board 1801.

In a preferred embodiment, board 1801 is a PCB board and includes components such as processor 1101 and memory 1105. In a preferred embodiment, one or more of USB ports 1104 is connected to board 1801. In this embodiment, cable 1618 is connected to a first USB port 1104 and power port 1619 is a second USB port 1104. Other suitable arrangements known in the art may be employed.

Figure 20A:
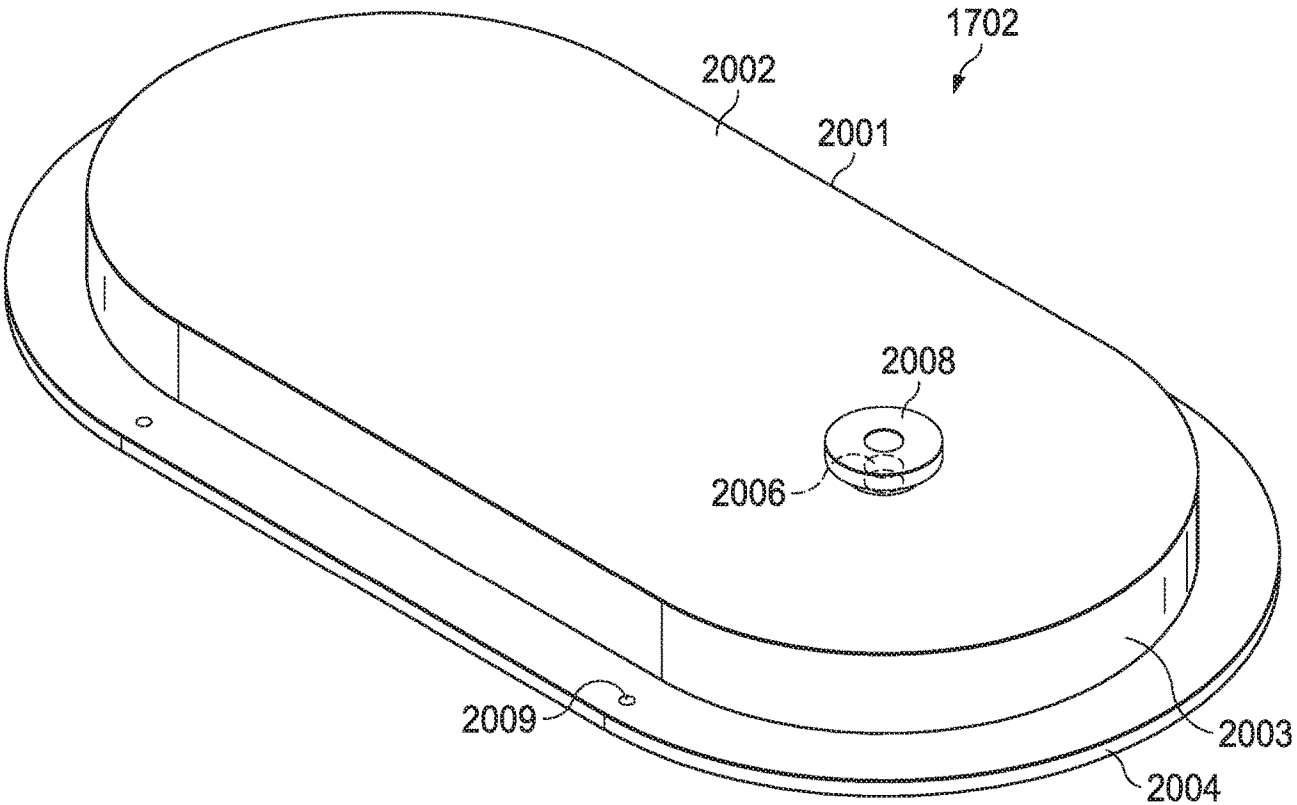
FIG. 20A is an isometric view of an inner shell of a headset of a preferred embodiment.
Figure 20B:
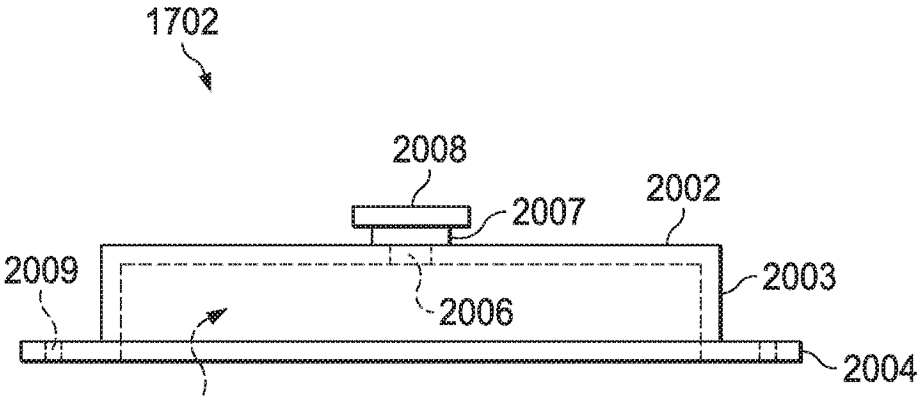
FIG. 20B is an end sectional view of an inner shell of a headset of a preferred embodiment.

Referring to FIGS. 20A and 20B, inner shell 1702 includes platform 2001 and annular side 2003 to form shell cavity 2010. Annular ring 2004 is attached to annular side 2003. Set of holes 2009 is integrally formed into annular ring 2004 and sized to receive a set of fasteners. Platform 2001 includes surface 2002 and forms cavity 2010 opposite surface 2002. Post 2007 is attached to platform 2001 and has hole 2006 that extends through platform 2001 into cavity 2010. Ring 2008 is attached to post 2007 opposite platform 2002.

In a preferred embodiment, ring 2008 has a diameter greater than a diameter of post 2007.

Figure 25:
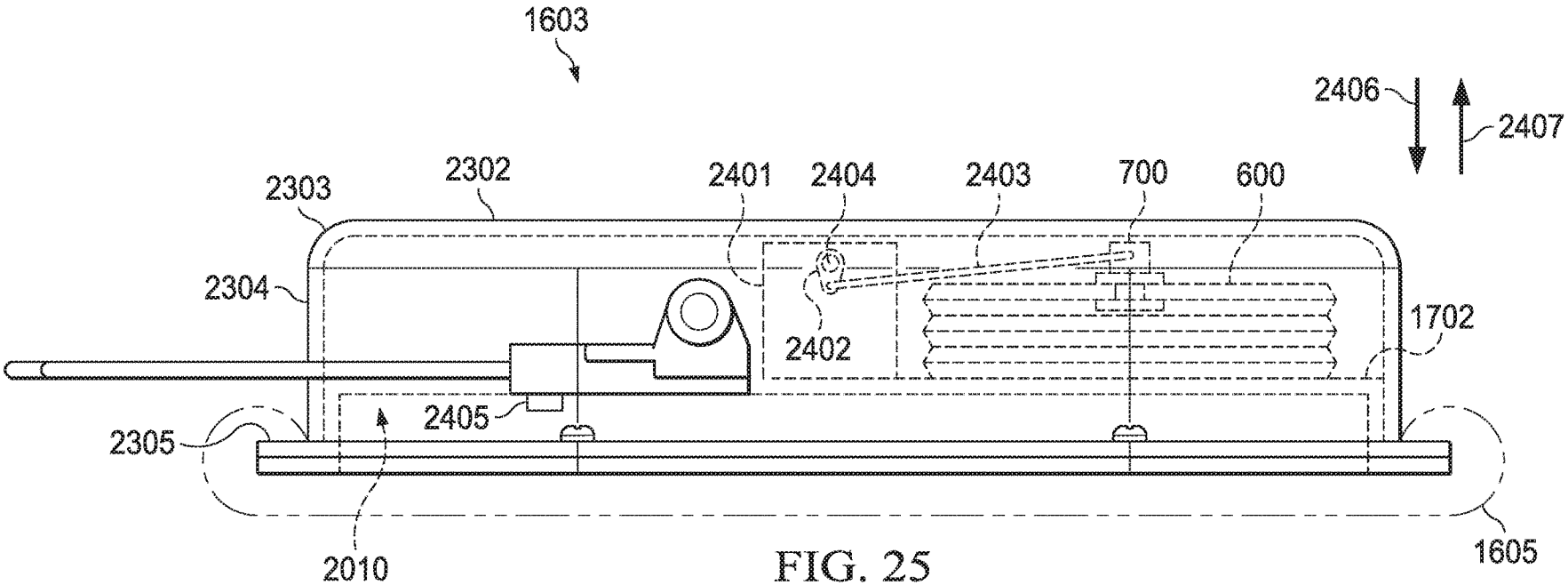
FIG. 25 is a side sectional view of an earpiece of a preferred embodiment.

In a preferred embodiment, pump 600 is wrapped around ring 2008 such that ring 2008 is inserted into pump 600 as shown in FIGS. 19 and 25. In this embodiment, pump 600 engages and is secured adjacent to platform 2002, preferably with an adhesive to form a substantially airtight attachment.

In a preferred embodiment, inner shell 1702 is made of plastic. Other suitable materials known in the art may be employed including metals and metal alloys.

Figure 21B:
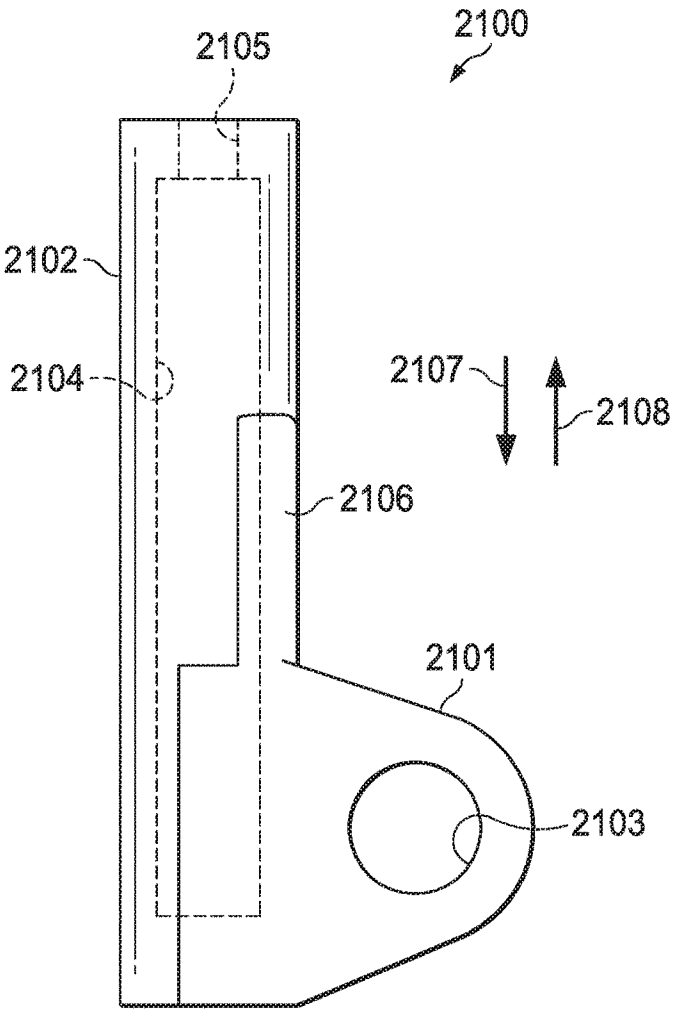
FIG. 21B is a side view of a connector of a headset of a preferred embodiment.
Figure 21A:
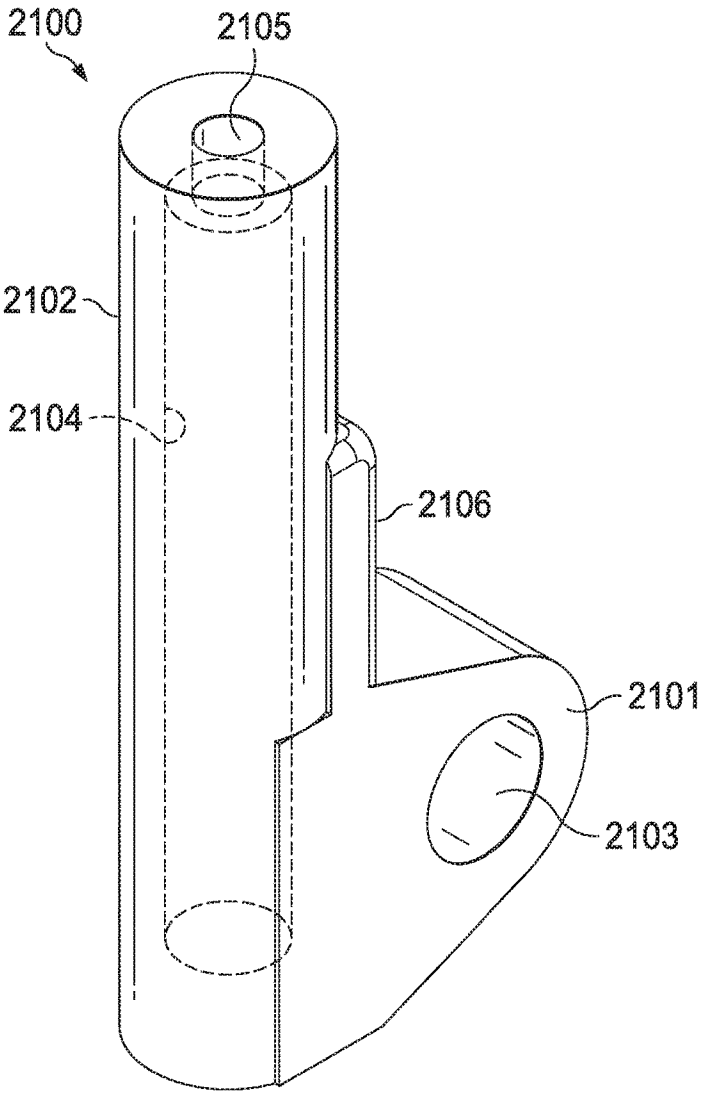
FIG. 21A is an isometric view of a connector of a headset of a preferred embodiment.

Referring to FIGS. 21A and 21B, each of connectors 1704 and 1706 will be further described as connector 2100. Connector 2100 includes mounting portion 2101 and housing 2102. Mounting portion 2101 includes bore 2103 which is sized to accommodate a peg for rotatable connection and support 2106. Housing 2102 includes cavity 2104 and hole 2105. In a preferred embodiment, hole 2105 has a diameter less than a diameter of cavity 2104 to form an annular shoulder in cavity 2104. In this way, a wire of an earpiece or a control earpiece moves generally along directions 2107 and 2108 without removal from connector 2100.

In a preferred embodiment, connector 2100 is made of plastic. Other suitable materials known in the art may be employed including metals and metal alloys.

Figure 22:
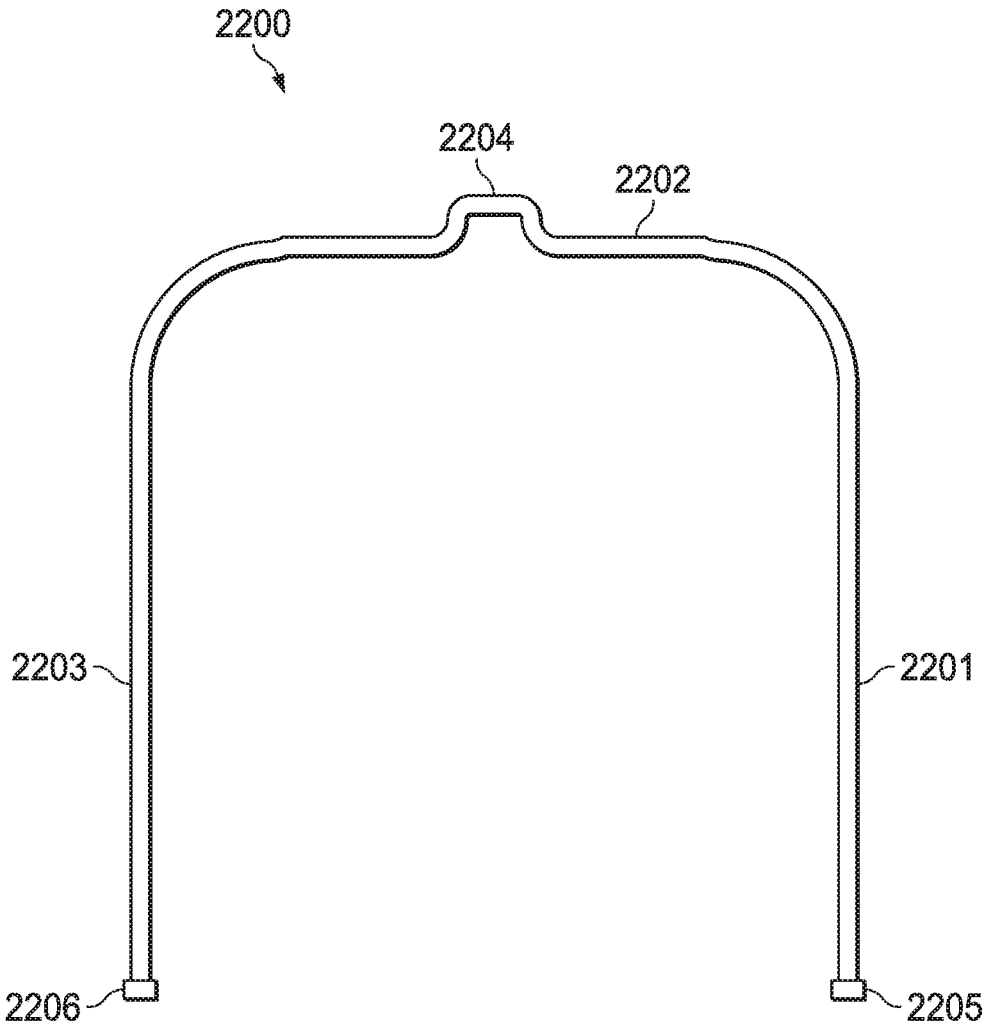
FIG. 22 is a side view of a connector wire of a headset of a preferred embodiment.

Referring to FIG. 22, each of wires 1612 and 1617 will be further described as wire 2200. Wire 2200 includes connector portions 2201 and 2203 and headband portion 2202. Connector portion 2201 has shoulder 2205. Connector portion 2203 has shoulder 2206. Headband portion 2202 has tab 2204 integrally formed therein.

In a preferred embodiment, wire 2200 is made of an 8 gauge metal wire. Other suitable materials and sizes, including plastics may be employed.

Figure 23:
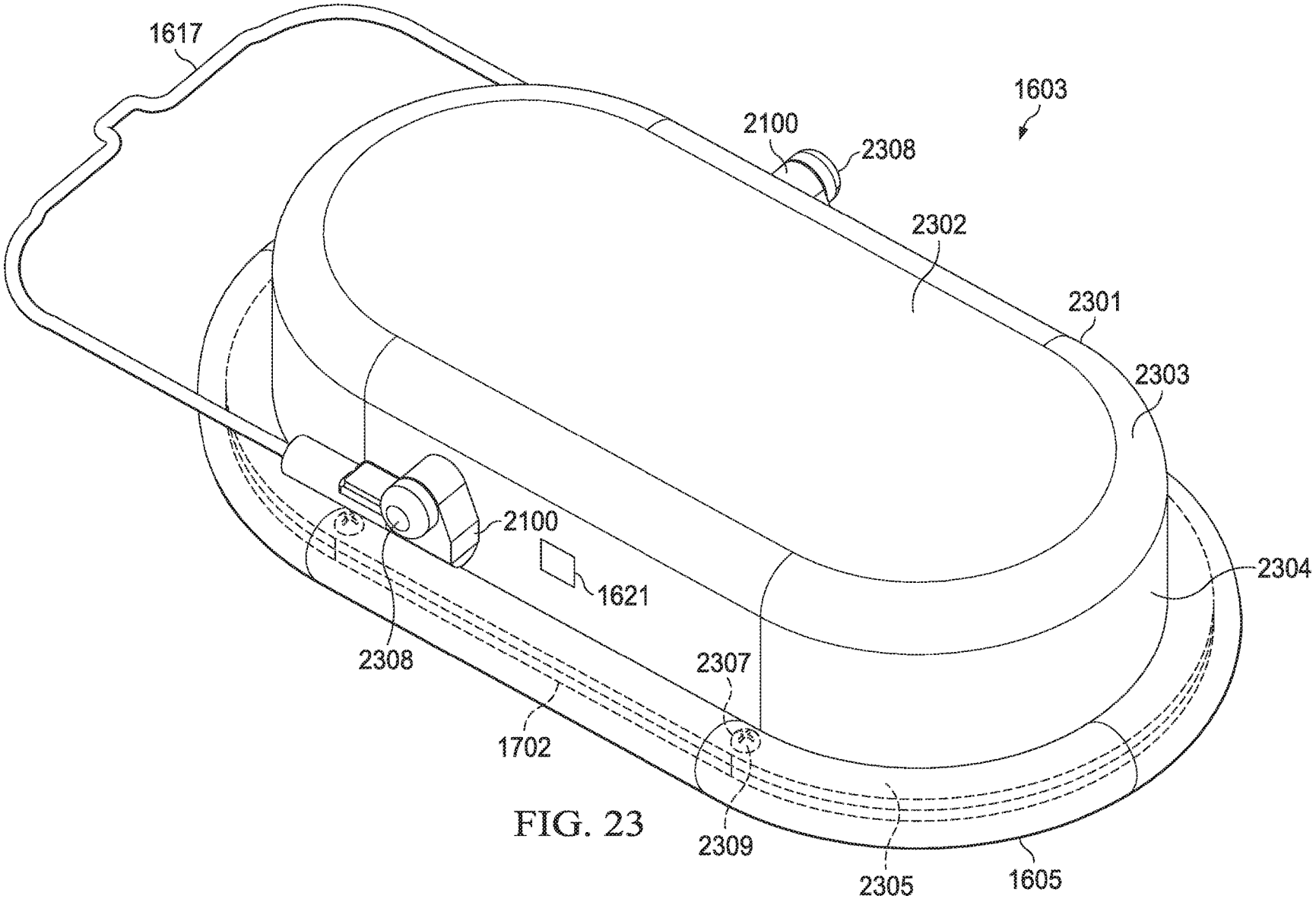
FIG. 23 is an isometric view of an earpiece of a preferred embodiment.

Referring to FIG. 23, earpiece 1603 includes outer shell 2301 connected to inner shell 1702 with set of fasteners 2307. Each of connectors 2100 is movably connected to outer shell 2301 with pin 2308 and slidably engaged with wire 1617. Outer shell 2301 includes outer surface 2302, transition 2303, annular side 2304, and annular ring 2305. Annular ring 2305 includes a set of holes 2309, each of which is sized to accommodate a corresponding fastener of set of fasteners 2307. Annular pad 1605 is attached to annular ring 2305 and an annular ring of inner shell 1702.

In a preferred embodiment, earpiece 1603 has a generally oval shape and is sized to fit over the ear of a user. Other suitable shapes, sizes, and fits known in the art may be employed, including ear bud styles.

In a preferred embodiment, outer shell 2301 is made of plastic. Other suitable materials known in the art may be employed including metal and metal alloys.

Figure 24:
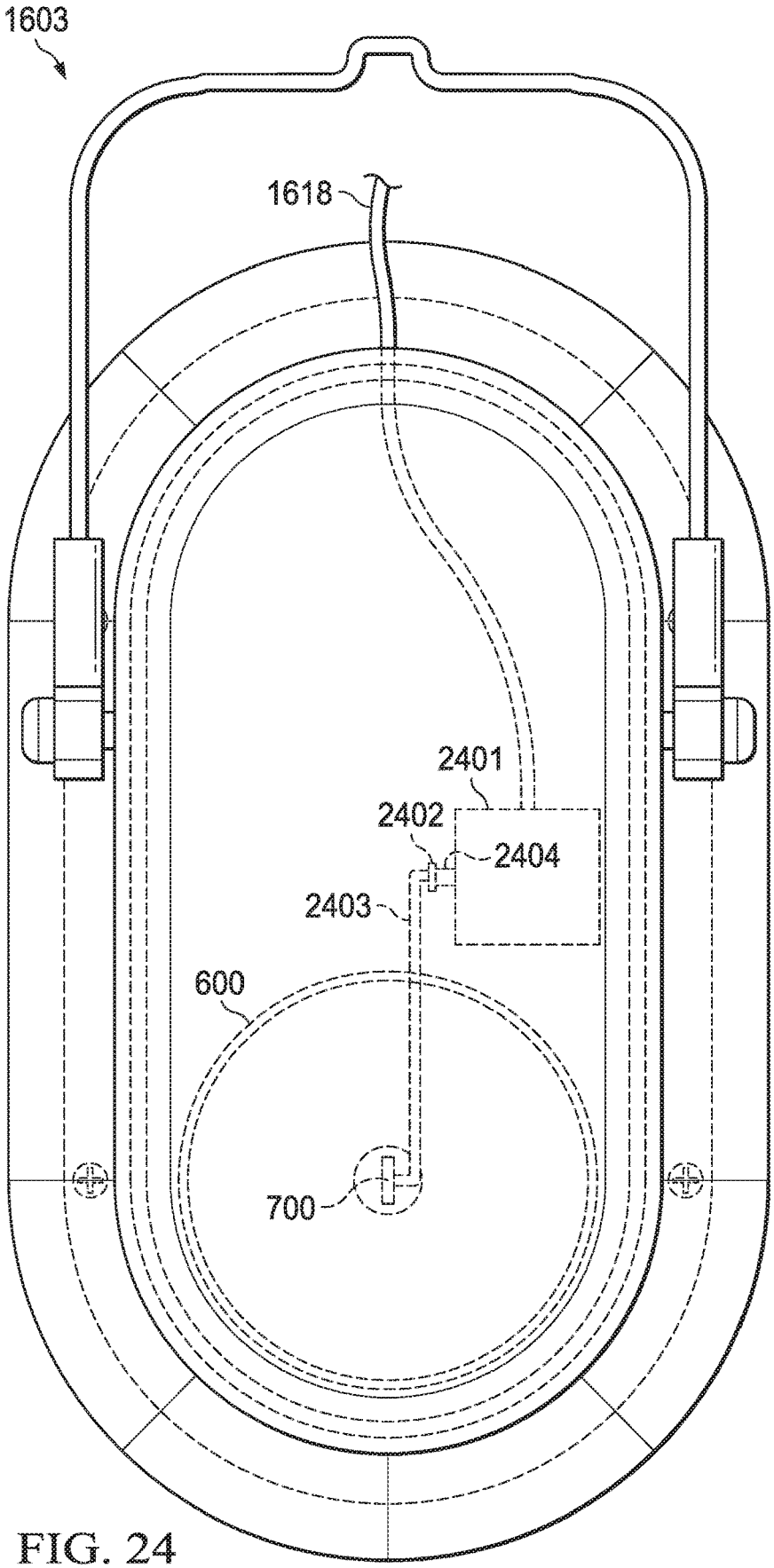
FIG. 24 is a side sectional view of an earpiece of a preferred embodiment.

Referring to FIGS. 24 and 25, earpiece 1603 further includes motor 2401 connected to cable 1618 and mounted to inner shell 1702. Motor 2401 includes shaft 2404, which is rotatably connected to crank arm 2402. Connector rod 2403 is rotatably connected to crank arm 2402. Connector 700 is rotatably connected to connector rod 2403 and connected to pump 600. Pump 600 is connected to inner shell 1702. Set of pressure sensors 2405 is attached to the inside of inner shell 1702 and connected to cable 1618. Cable 1618 is connected to board 1801 of control earpiece 1602.

In use, board 1801 of control earpiece 1602 controllably provides power from battery 1802 to motor 2401. Motor 2401 rotates shaft 2404 and, through crank arm 2402, connector rod 2403, and connector 700, moves pump 600 back and forth generally along directions 2406 and 2407 to provide air pressure in inner shell 1702 which is immediately adjacent to an ear of a user. Board 1801 further provides and receives data through cable 1618 connected to earpiece 1603. Set of pressure sensors 2405 provides data to board 1801 through cable 1618.

It will be appreciated by those skilled in the art that any number of connection arrangements known in the art may be employed to connect, directly or indirectly, each of motor 2401 and set of pressure sensors 2405 to cable 1618, including without limitation cable connectors, hubs, and adaptors.

It will be appreciated by those skilled in the art that control earpiece 1602 and earpiece 1603 may be worn on either the right or left ear of a user. In a preferred embodiment, control earpiece 1602 is worn on the right ear of the user. In this embodiment, earpiece 1603 is worn on the left ear of the user. In another embodiment, control earpiece 1602 is worn on the left ear of the user. In this embodiment, earpiece 1603 is worn on the right ear of the user. In other embodiments, earpiece 1603 is substituted by control earpiece 1602, which is worn on each of the left ear and right ear of the user such that each control earpiece 1602 controls the pressure in the ear on which the respective control earpiece 1602 is worn.

It will be appreciated by those skilled in the art that the embodiments disclosed in FIGS. 1-10C and in FIGS. 16-25 each employ the hardware and software components, arrangements, and functionality disclosed in FIGS. 11-15. It will be further appreciated by those skilled in the art that the embodiments disclosed in FIGS. 1-10C employ the power, data, motor, and pump arrangements employed in FIGS. 16-25.

It will be appreciated by those skilled in the art that modifications can be made to the embodiments disclosed and remain within the inventive concept. Therefore, this invention is not limited to the specific embodiments disclosed, but is intended to cover changes within the scope and spirit of the claims.

The invention claimed is:

1. A headset for adjusting air pressure, comprising:

a headband;

a first earpiece connected to the headband;

a second earpiece connected to the headband;

a first control system connected to the first earpiece;

a pump system connected to the first earpiece, to the second earpiece, and to the control system;

a first cavity of the first earpiece having a first adjustable air pressure;

a second cavity of the second earpiece having a second adjustable air pressure;

wherein the first control system comprises:

a processor;

a battery controllably connected to the processor;

a memory connected to the processor;

a USB port connected to the processor;

a first set of pressure sensors connected to the processor;

a second set of pressure sensors connected to the processor;

a set of pressure mode buttons connected to the processor;

a first set of pressure control buttons connected to the processor;

a second set of pressure control buttons connected to the processor;

a set of displays connected to the processor; and, a set of indicator LEDs connected to the processor.

2. The headset of claim 1, further comprising a second control system connected to the second earpiece and to the pump system.

3. The headset of claim 1, wherein the first earpiece comprises:

a first outer shell;

a first inner shell connected to the first outer shell; and, a first pad connected to the first inner shell.

4. The headset of claim 3, wherein the second earpiece comprises:

a second outer shell;

a second inner shell connected to the second outer shell; and, a second pad connected to the second inner shell.

5. The headset of claim 1, wherein the pump system further comprises:

a first motor connected to the processor;

a first pump movably connected to the first motor;

a second motor connected to the processor; and, a second pump movably connected to the second motor.

* * * * *